US009327541B2

(12) United States Patent
Nakajima et al.

(10) Patent No.: US 9,327,541 B2
(45) Date of Patent: May 3, 2016

(54) POST-PROCESSING APPARATUS AND IMAGE FORMING SYSTEM

(71) Applicant: KONICA MINOLTA, INC., Chiyoda-ku, Tokyo (JP)

(72) Inventors: Hirofumi Nakajima, Tokyo (JP); Eiji Sugimoto, Tokyo (JP); Takumi Shirakuma, Tokyo (JP); Shohei Otsu, Tokyo (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/250,273

(22) Filed: Apr. 10, 2014

(65) Prior Publication Data

US 2014/0308096 A1 Oct. 16, 2014

(30) Foreign Application Priority Data

Apr. 11, 2013 (JP) ..... 2013-083077

(51) Int. Cl.

| | |
|---|---|
| ***B42C 1/12*** | (2006.01) |
| ***B65H 37/04*** | (2006.01) |
| ***B31F 1/00*** | (2006.01) |
| ***B31F 5/00*** | (2006.01) |
| ***B42C 19/00*** | (2006.01) |

(52) U.S. Cl.

CPC ..... *B42C 1/12* (2013.01); *B31F 1/0035* (2013.01); *B31F 5/003* (2013.01); *B42C 19/00* (2013.01);

(Continued)

(58) Field of Classification Search

CPC ..... B42C 1/12; B65H 2301/515; B65H 2301/51532; B65H 37/04; B65H 2801/27; B31F 1/0035; B31F 5/003

USPC ..... 270/45, 52.17, 52.18, 52.26, 58.07, 270/58.08; 412/33

See application file for complete search history.

(56) References Cited

U.S. PATENT DOCUMENTS 5,520,604 A * 5/1996 Reist ..... 493/422
6,709,375 B2 * 3/2004 Groenenberg et al. ..... 493/442

(Continued)

FOREIGN PATENT DOCUMENTS

JP 2000211806 A 8/2000
JP 2005238828 A 9/2005

(Continued)

OTHER PUBLICATIONS

Japanese Office Action (and English translation thereof) dated Mar. 17, 2015, issued in counterpart Japanese Application No. 2013-083077.

*Primary Examiner* — Leslie A Nicholson, III
(74) *Attorney, Agent, or Firm* — Holtz, Holtz & Volek PC

(57) ABSTRACT

The image forming system contains an image forming apparatus and a post-processing apparatus. The post-processing apparatus includes a flattening unit that flattens a back portion of a booklet, an elevating mechanism that moves the flattening unit operating together with a conveyance of the booklet and a post-processing control portion that controls the flattening unit to perform flattening processing which flattens the back portion of the booklet during the conveyance of the booklet by the elevating mechanism. The elevating mechanism elevates a booklet-holding mechanism including the flattening unit operating together with a conveyance of the booklet. The booklet-holding mechanism and the flattening unit moves up and down between cut-off processing portion and discharging portion operating together with the conveyance of the booklet. A square back roller reciprocatively moves along the back portion of the booklet together with the movement of roller moving mechanism.

13 Claims, 17 Drawing Sheets

(52) U.S. Cl.
CPC ..... *B65H 37/04* (2013.01); *B65H 2301/515* (2013.01); *B65H 2301/51532* (2013.01); *B65H 2801/27* (2013.01)

(56) References Cited

U.S. PATENT DOCUMENTS

| | | | | |
|---|---|---|---|---|
| 7,431,273 | B2 * | 10/2008 | Kamiya et al. | 270/37 |
| 7,431,274 | B2 * | 10/2008 | Kushida | B65H 37/06 270/32 |
| 8,152,152 | B2 * | 4/2012 | Sakata | 270/52.18 |
| 8,191,882 | B2 | 6/2012 | Kikkawa et al. | |
| 8,353,504 | B2 * | 1/2013 | Hattori et al. | 270/45 |
| 8,573,583 | B2 * | 11/2013 | Musha et al. | 270/58.17 |
| 2013/0011219 | A1 * | 1/2013 | Musha et al. | 412/16 |

FOREIGN PATENT DOCUMENTS

| | | | |
|---|---|---|---|
| JP | 2007137665 | A | 6/2007 |
| JP | 2009-227449 | A | 10/2009 |
| JP | 2010-036403 | A | 2/2010 |
| JP | 2010-265115 | A | 11/2010 |

* cited by examiner

POST-PROCESSING APPARATUS AND IMAGE FORMING SYSTEM

CROSS REFERENCE TO RELATED APPLICATION

The present invention contains subject matter related to Japanese Patent Application No. 2013-083077 filed in the Japanese Patent Office on Apr. 11, 2013, the entire contents of which being incorporated herein by reference.

BACKGROUND OF THE INVENTION

1. Field of the Invention

The present invention relates to a post-processing apparatus and an image forming system using the same.

2. Description of Related Art

Recently, in an art of production printing, an image forming system has been widely used in which any various systems can be structured by connecting an image forming apparatus with any peripheral equipment such as a large capacity sheet feeder and the post-processing apparatus. The post-processing apparatus includes, for example, bookbinding equipment that binds a booklet by performing any center-folding processing or saddle stitching processing on sheets of paper on each of which the image forming apparatus forms an image. The post-processing apparatus also includes other equipment that performs a stapling processing or punching processing.

When performing the saddle stitching processing as the post processing, if plural saddle-stitching-processed booklets are stacked on, for example, a table, they may collapse because of their curved ends (herein after, referred to as "back portions") in each of which a fold is formed. Further, there may be an issue where they are bulgy in their back portions when storing and carrying the booklets. Accordingly, when performing the saddle stitching processing, any flattening processing for flattening the back portion of each booklet so as to form a sectionally angular shape (square back processing) has been performed by applying any pressure on the curved portion of the back portion of each booklet to flatten the back portion of each booklet.

Japanese Patent Application Publication No. 2009-227449 discloses recording material post-processing device that has a constraint means for constraining the neighborhood of the spine of the booklet in which the bundle of recording materials is folded at the center and arranging the spine of the booklet to protrude from a booklet constrain position. This device also has a pressing means for pressing the spine of booklet constrained by the constraining means to form a flat spine surface from the curved spine surface.

Japanese Patent Application Publication No. 2010-265115 discloses a spine forming apparatus which has a pair of conveying rollers that conveys a bundle of sheets folded in half with a curved folded portion of the bundle of sheets directing forward, pressing means for pressing and nipping the forward end of the bundle of sheets and spine forming means for forming the spine by flattening the curved folded portion. The pressing means includes first pressing members and second pressing members for nipping the bundle of sheets operating together with the pressing operation of the first pressing members and applies a spine forming load onto the folded portion of the bundle of sheets.

Japanese Patent Application Publication No. 2010-036403 discloses a booklet-forming apparatus that flattens a back of the conveying booklet by rotating a pair of first pressing and conveying rollers around a shaft while nipping the booklet and conveying the booklet along a first guide portion while the back of the booklet is pressed on the first guide portion.

SUMMARY OF THE INVENTION

The apparatuses disclosed in Japanese Patent Application Publications No. 2009-227449, 2010-265115 and 2010-036403, however, have performed the flattening processing after the conveying booklet stops temporarily when flattening the back portion of each of the booklets. Accordingly, each booklet may be required to stop when flattening the back portion of each booklet. This may result in less productivity in the image forming system. Particularly, when performing the flattening processing plural times in order to flatten the back portion of each booklet definitely, it takes a lot of processing time.

This invention addresses the above-mentioned issues and has an object to provide an improved post-processing apparatus and an image forming system using the same, which prevent any productivity in the image forming system from deteriorating even when flattening the back portion of each booklet.

To achieve the above-mentioned object, a post-processing apparatus reflecting one aspect of this invention contains a booklet-forming portion that performs saddle stitching processing on a sheet of paper to form a booklet, a flattening portion that flattens a back portion of the booklet formed by the booklet-forming portion, a moving portion that moves the flattening portion operating together with a conveyance of the booklet, and a control device that is configured to control the flattening portion to perform flattening processing which flattens the back portion of the booklet during the conveyance of the booklet by the moving portion.

It is desirable to provide the post-processing apparatus further containing a cut-off processing portion that cuts off an edge of the booklet wherein the control device is configured to control the cut-off processing portion to cut off the edge of the booklet during the flattening processing by the flattening portion.

It is also desirable to provide the post-processing apparatus further containing a first driving portion that drives the flattening portion and a second driving portion that drives the cut-off processing portion wherein the control device is configured to control the first driving portion and the second driving portion, respectively, to allow a start timing of the first driving portion to be different from a start timing of the second driving portion.

It is still desirable to provide the post-processing apparatus wherein the control device is configured to change a moving speed of the moving portion based on whether or not the flattening portion flattens the back portion of the booklet.

It is further desirable to provide the post-processing apparatus further containing a third driving portion that drives the moving portion wherein the control device is configured to change a current value of the third driving portion based on whether or not the flattening portion flattens the back portion of the booklet.

It is additionally desirable to provide the post-processing apparatus wherein the control device is configured to change a moving speed of the moving portion based on a period of time when the flattening portion flattens the back portion of the booklet.

It is still further desirable to provide the post-processing apparatus further containing a third driving portion that drives the moving portion wherein the control device is configured to change a current value of the third driving portion based on a period of time when the flattening portion flattens the back portion of the booklet.

It is still additionally desirable to provide the post-processing apparatus wherein the control device is configured to change a moving speed of the moving portion based on whether or not the cut-off processing portion cuts off the edge of the booklet.

It is additionally desirable to provide the post-processing apparatus further containing a second driving portion that drives the cut-off processing portion wherein the control device is configured to change a current value of the second driving portion based on whether or not the cut-off processing portion cuts off the edge of the booklet.

An image forming system reflecting another aspect of this invention includes an image forming apparatus that forms an image on a sheet of paper and a post-processing apparatus that performs post-processing on the sheet of paper supplied from the mage forming apparatus. The post-processing apparatus contains a booklet-forming portion that performs saddle stitching processing on a sheet of paper to form a booklet, a flattening portion that flattens a back portion of the booklet formed by the booklet-forming portion, a moving portion that moves the flattening portion operating together with a convey of the booklet, and a control device that is configured to control the flattening portion to perform flattening processing which flattens the back portion of the booklet during the convey of the booklet by the moving portion.

In this invention, the conveyance of the booklet includes an interval when the booklet is conveyed from its receiving position (initial position) to the cut-off processing portion that cuts off the edge of the booklet, a cut-off interval thereof, and an interval when the booklet is conveyed from the cut-off processing portion to a discharging portion from which the booklet is discharged.

The concluding portion of this specification particularly points out and directly claims the subject matter of the present invention. However, those skilled in the art will best understand both the organization and method of operation of the invention, together with further advantages and objects thereof, by reading the remaining portions of the specification in view of the accompanying drawing(s) wherein like reference characters refer to like elements.

DESCRIPTION OF THE PREFERRED EMBODIMENTS

Figure 1:
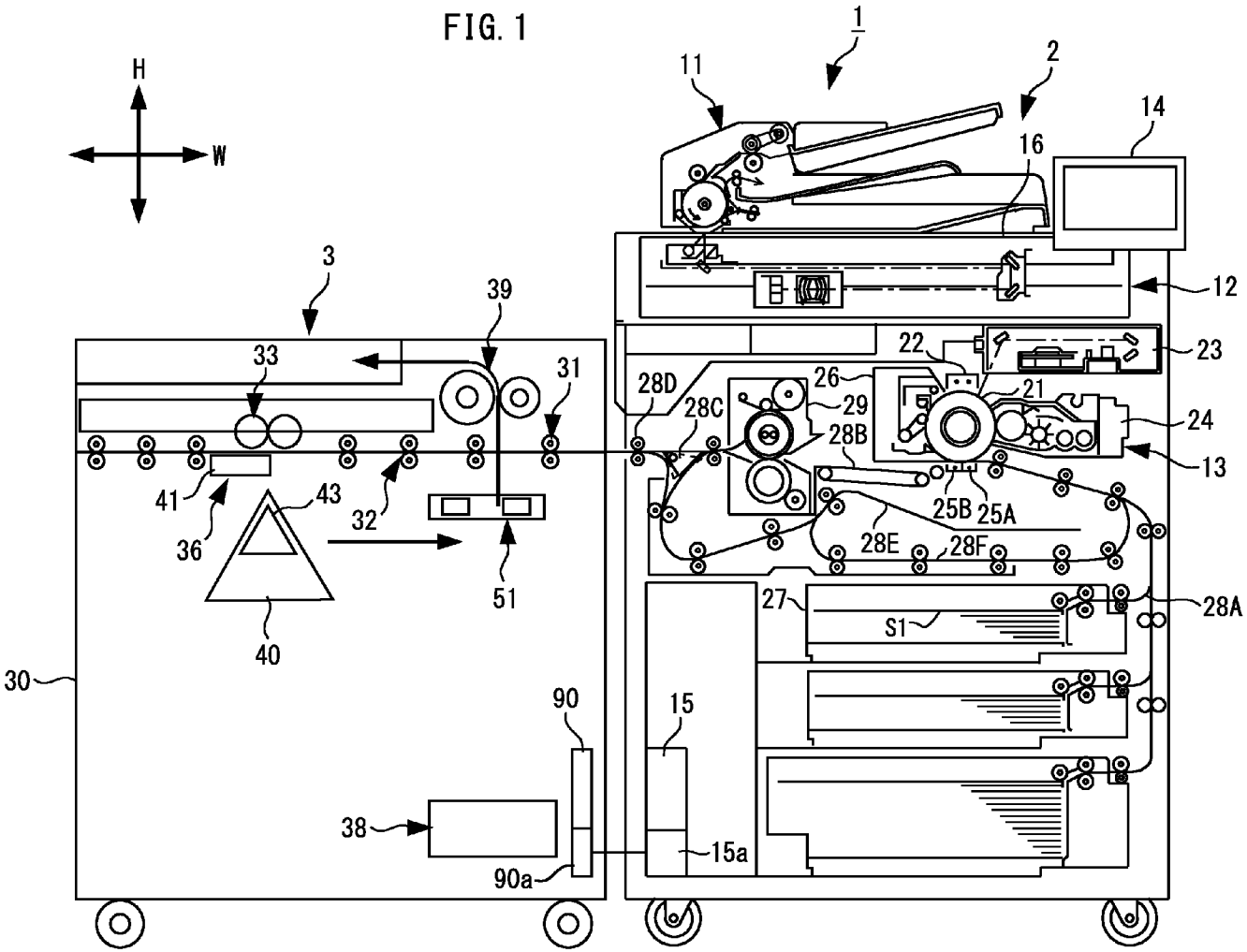
FIG. 1 is a diagram showing a configuration example of an image forming system according to an embodiment of this invention.

The following will describe configuration examples of the past-processing apparatus and the image forming system as preferred embodiments relating to the invention with reference to drawings. It is to be noted that any components having the substantially same configuration in the specification and drawings will be denoted by the identical symbol and their description will be omitted. Further, a size and/or a ratio in the drawings illustrated later may be shown in an exaggerated way for their description, which may be different from their actual ratios. It is also to be noted that the description in the embodiments is exemplified and any technical scope of the claims and/or meaning of term (s) claimed in the claims are not limited thereto.

(Configuration Example of Image Forming System)

First, the following will describe a configuration example of the image forming system 1. FIG. 1 shows an overall configuration example of the image forming system 1 according to the invention. As shown in FIG. 1, the image forming system 1 contains an image forming apparatus 2 and a post-processing apparatus 3 connecting the image forming apparatus 2 at a downstream side thereof along a sheet-conveying direction.

The image forming apparatus 2 forms a desired image on a sheet of paper S1 based on electrophotographic system and conveys the sheet of paper S1 thus image-formed to the post-processing apparatus 3. The post-processing apparatus 3 performs center-folding processing on the sheets of paper S1, on each of which the desired image has been formed by the image forming apparatus 2. The post-processing apparatus 3 then performs saddle stitching processing on the sheets of paper S1 by staples to form a bundle of sheets of paper (hereinafter, referred to as "booklet") S2. The post-processing apparatus 3 further flattens the back portion of the booklet S2 during a conveyance of the booklet S2.

(Configuration Example of Image Forming Apparatus)

The following will describe a configuration example of the image forming apparatus 2 more in detail. As shown in FIG. 1, the image forming apparatus 2 contains a document feeder 11, an image-reading portion 12, an image-forming portion 13, a manipulation and display portion 14 and an image forming control portion 15.

The document feeder 11 feeds the documents one by one to a reading position in the image-reading portion 12. The image-reading portion 12 reads an image of the document fed from the document feeder 11 or mounted on a document table 16 to generate image data.

The image-forming portion 13 contains a photosensitive drum 21, a charging portion 22 arranged around the photosensitive drum 21, an exposing portion 23, a developing portion 24, a transferring portion 25A, a separating portion 25B and a cleaning portion 26. The charging portion 22 uniformly charges static charges around a surface of the photosensitive drum 21. The exposing portion 23 exposes and scans on a surface of the photosensitive drum 21 to form an electrostatic latent image thereon based on the image data read from the document. The developing portion 24 applies toner to develop the latent image and form a toner image on the surface of the photosensitive drum 21.

A sheet-storing unit 27 stores sheets of paper S1. A feeding portion 28A feeds each sheet of paper S1 to send each sheet of paper S1 to a transfer position in which the transferring portion 25A is arranged. The transferring portion 25A transfers the toner image on the sheet of paper S1 sent to the transfer position. The separating portion 25B erases static charges on a rear surface of the sheet of paper S1, to a surface of which the toner image has been transferred, to separate the sheet of paper S1 from the photosensitive drum 21. The cleaning portion 26 then removes residual toner from the surface of the photosensitive drum 21.

Intermediate conveying portion 28 conveys the sheet of paper s1 separated from the photosensitive drum 21 to a fixing portion 29. The fixing portion 29 heats and fixes the toner image transferred on the sheet of paper S1.

A changeover gate 28C is positioned at a downstream side (hereinafter, referred to as "downstream side") of the fixing portion 29 along the conveying direction of the sheet of paper S1. The changeover gate 28C changes over a conveying route of the sheet of paper S1 passed through the fixing portion 29. In other words, the changeover gate 28C keeps the sheet of paper S1 going straight when performing a face up sheet discharge in a case of single surface image forming. A pair of sheet discharging rollers 28D then discharges the sheet of paper S1. Alternatively, the changeover gate 28C guides the sheet of paper S1 to a sheet-reverse conveying portion 28E arranged downward when performing a face down sheet discharge in a case of single surface image forming or when performing duplex printing.

When performing the face down sheet discharge, the changeover gate 28C changes over the conveying route of the sheet of paper S1 when the rear end of the sheet of paper S1 passes through the changeover gate 28C after the sheet of paper S1 is guided downward. The pair of discharging rollers 28D discharges the sheet of paper S1.

When performing the duplex printing, the changeover gate 28C guides the sheet of paper S1 downward and conveys it to the sheet-reverse conveying portion 28E. The sheet-reverse conveying portion 28E then reverses the sheet of paper S1 and conveys the sheet of paper S1 again to the transfer position through a re-feeding route 28F.

The manipulation and display portion 14 contains a touch panel and the like. The manipulation and display portion 14 functions as an input portion, through which a user inputs any job information to operate the image forming apparatus 2 and the post-processing apparatus 3. A user can input a size selection of the sheet of paper and/or number selection thereof as the job information through the manipulation and display portion 14. The user also can input, as the job information, selection of the center-folding processing or saddle stitching processing or whether or not there is the flattening processing or the cut-off processing, numbers of sheets of paper to be bound in the saddle stitching processing, a period of flattening time or the like. The manipulation and display portion 14 sends the input job information to the image forming control portion 15.

The manipulation and display portion 14 also contains a start button. When the user inputs any job information and pushes the start button down through the manipulation and display portion 14, the image forming apparatus 2 and the post-processing apparatus 3 start their operations based on the input job information.

The image forming control portion 15 receives the job information and controls any image forming operations of the image forming apparatus 2 based on the received job information. A communication portion 15*a* of the image forming control portion 15 electrically connects a communication portion 90*a* of a post-processing control portion 90 in the post-processing apparatus 3. The image forming control portion 15 of the image forming apparatus 2 performs serial communication with the post-processing control portion 90 of the post-processing apparatus 3. The post-processing control portion 90, which is the control device according to the invention, controls the post-processing apparatus 3 so that the post-processing control portion 90 runs operating together with any image forming operation in the image forming apparatus 2.

(Configuration Example of Post-Processing Apparatus)

Figure 2:
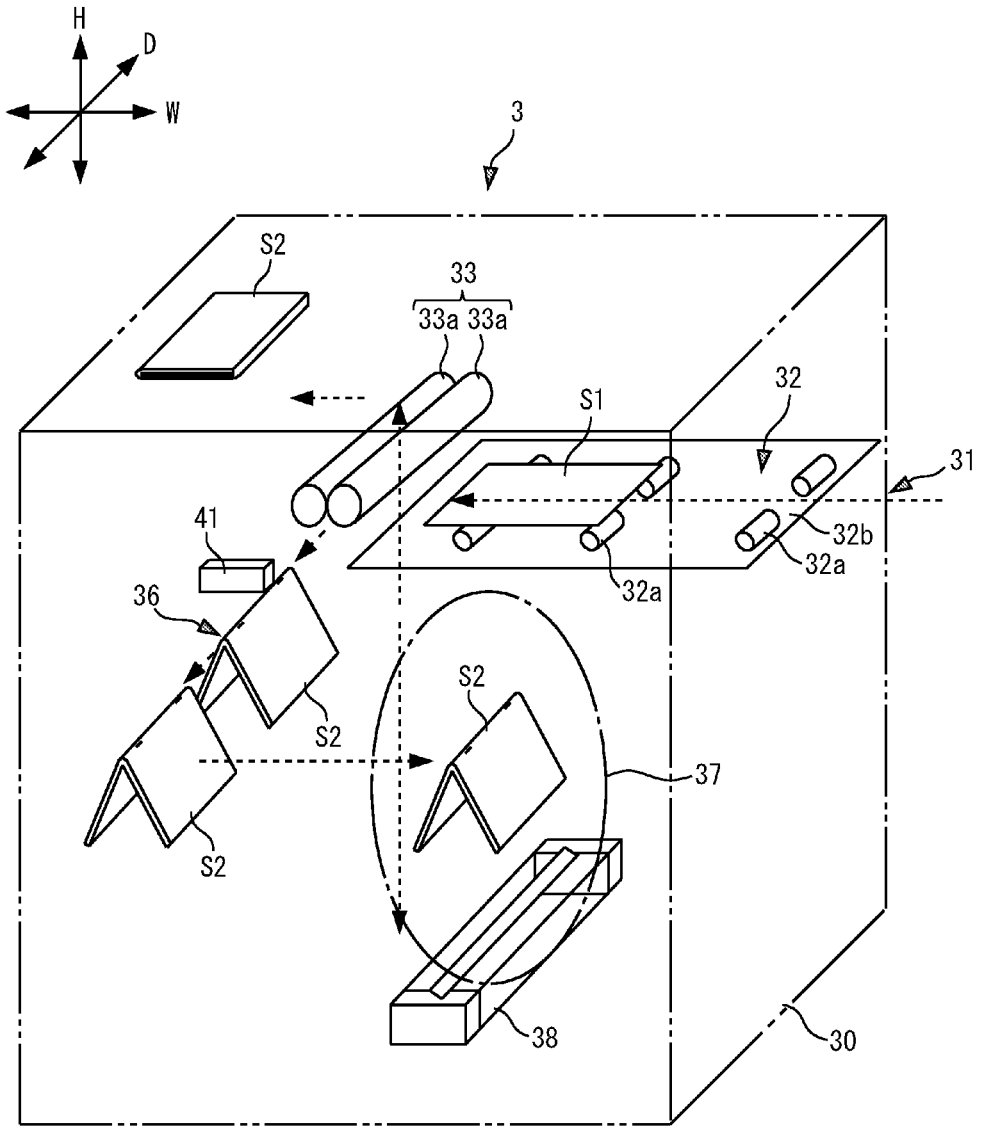
FIG. 2 is a diagram showing a configuration example of a post-processing apparatus according to an embodiment of this invention.

The following will describe a configuration example of the post-processing apparatus 3 more in detail. FIG. 2 shows a configuration example of the post-processing apparatus 3. Here, a direction which is parallel with a horizontal direction of the post-processing apparatus 3 and in which the post-processing apparatus 3 and the image forming apparatus 2 are opposed to each other is referred to as "width direction W". A direction that is perpendicular to the width direction Wand is parallel with a vertical direction is referred to as "height direction H". A direction that is perpendicular to the width direction W and the height direction H is referred to as "depth direction D".

As shown in FIGS. 1 and 2, the post-processing apparatus 3 contains a receiving portion 31, a first sheet-conveying portion 32, a center-folding processing portion 33, a second sheet-conveying portion 34 (see FIGS. 3A through 3C), a saddle stitching processing portion 36 and a combined processing portion 37. A booklet-forming portion performs the saddle stitching processing on the sheets of paper S1 to form the booklet S2. The booklet-forming portion contains the center-folding processing portion 33 and the saddle stitching processing portion 36.

The receiving portion 31 is provided at one side of a case 30 along the width direction W in the post-processing apparatus 3. The receiving portion 31 opens in a surface of the case 30, which opposes the image forming apparatus 2. The receiving portion 31 receives the sheet of paper S1 discharged from the sheet discharging rollers 28D of the image forming apparatus 2 (see FIG. 1).

The first sheet-conveying portion 32 contains plural rollers 32*a* driven by a motor, not shown, and a conveying path 32*b* arranged along the width direction W. The first sheet-conveying portion 32 conveys the sheet of paper S1 received by the receiving portion 31 to the center-folding processing portion 33.

The center-folding processing portion 33 contains two folding rollers 33*a*, 33*a* which are pressed to each other, and a folding plate, not shown. The two folding rollers 33*a*, 33*a* rotate each other in their reverse directions. The folding plate presses a center of the sheet of paper S1 and passes through the center of the sheet of paper S1 between the two folding rollers 33*a*, 33*a*. Then, the two folding rollers 33*a*, 33*a* reversely rotate and exit the sheet of paper S1 downward along the height direction H. This allows the sheet of paper S1 to be folded with the center thereof being convex upward along the height direction H. Thus, the center-folding processing finishes.

Figure 3A:
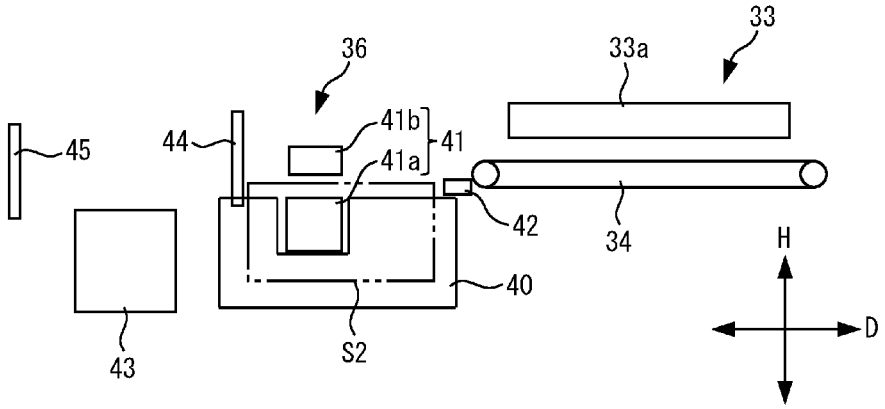
FIG. 3A is a diagram showing an outline of saddle stitching processing (Part one)
Figure 3B:
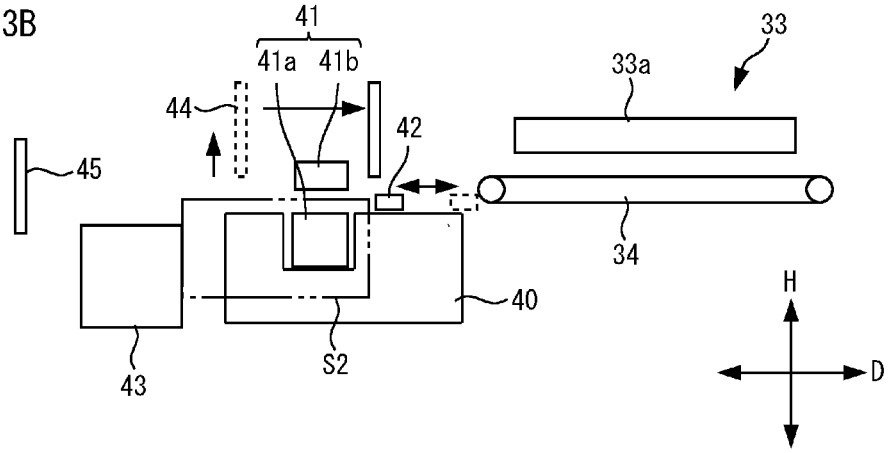
FIG. 3B is a diagram showing the outline of the saddle stitching processing (Part two)
Figure 3C:
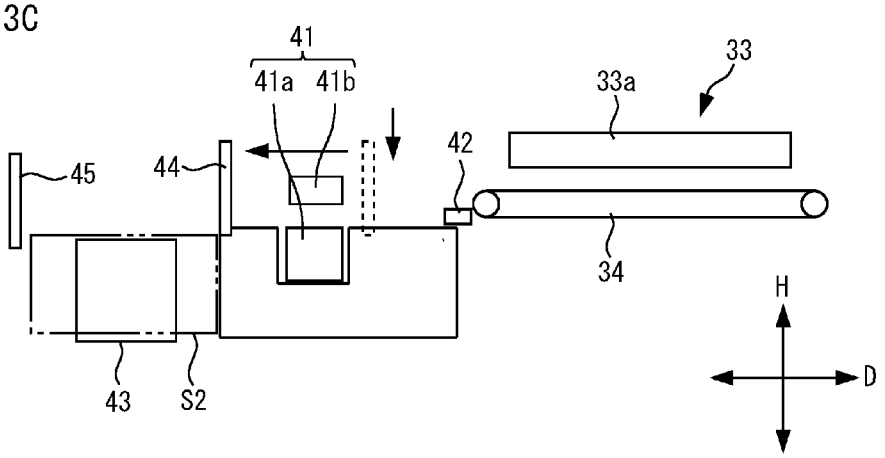
FIG. 3C is a diagram showing the outline of the saddle stitching processing (Part three)

FIGS. 3A through 3C show an outline of the saddle stitching processing portion 36 in the post-processing apparatus 3, seen from the width direction W. As shown in FIG. 3A, the second sheet-conveying portion 34 is located under the two folding rollers 33*a*, 33*a* of the center-folding processing portion 33 along the height direction H. The second sheet-conveying portion 34 extends along the depth direction D. The second sheet-conveying portion 34 conveys the sheets of paper S1 center-folded by the center-folding processing portion 33 to the saddle stitching processing portion 36.

The saddle stitching processing portion 36 contains a sheet-stacking portion 40, a stapling portion 41, an aligning portion 42 and a first stopper 44. The sheet-stacking portion 40 has a sectionally triangular shape seen from the depth direction D with one peak thereof facing upward along the height direction H. The sheet-stacking portion 40 stacks the center-folded sheets of paper S1 with their inner sides of the folded portions thereof mounting on the peak of the sheet-stacking portion 40. In this moment, the folded portions of the sheets of paper S1 are put on a ridgeline of the peak of the sheet-stacking portion 40. Thus, the sheet-stacking portion 40 stacks the plural sheets of paper S1.

The stapling portion 41 contains a clinching mechanism 41*a* arranged in the sheet-stacking portion 40 and a stapling mechanism 41*b* opposed to the clinching mechanism 41*a*. A supporting portion, not shown, supports the clinching mechanism 41*a* to be liftable along the height direction H. A mounting member, not shown, fixes and mounts the stapling mechanism 41*b* above the sheet-stacking portion 40 along the height direction H.

The aligning portion 42 and the first stopper 44 are positioned above the sheet-stacking portion 40 along the height direction H. The aligning portion 42 is movable along the depth direction D. The first stopper 44 is movable along the height direction H and the depth direction D. A booklet-conveying portion 43 is arranged at a downstream side of the sheet-stacking portion 40 along the depth direction D. A second stopper 45 is arranged upward the booklet-conveying portion 43 along the height direction H.

Here, the following will describe the saddle stitching processing in the saddle stitching processing portion 36 with reference to FIGS. 3A through 3C. First, as shown in FIG. 3A, the aligning portion 42 aligns the sheets of paper S1 (booklet S2) by pressing the sheets of paper S1 against the first stopper 44 after the sheet-stacking portion 40 stacks the predetermined number of sheets of paper S1 to form the bundle of the sheets of paper S1. Next, the clinching mechanism 41*a* of the stapling portion 41 lifts to perform a first stapling on the bundle of the sheets of paper S1. In this moment, the first stopper 44 lifts up to a predetermined height.

When performing the first stapling, as shown in FIG. 3B, the aligning portion 42 moves to a downstream side along the depth direction D by a predetermined amount of movement. This allows the aligning portion 42 to push the bundle of the sheets of paper S1 to a position on which a second stapling will be performed on the bundle of the sheets of paper S1. The clinching mechanism 41*a* of the stapling portion 41 then lifts to perform a second stapling on the bundle of the sheets of paper S1 to form the booklet S2.

While performing the second stapling, the first stopper 44 moves toward a side of the center-folding processing portion 33 along the depth direction D to reach a position above the upstream end of booklet S2. The aligning portion 42 moves back to a predetermined position along the depth direction D.

When performing the second stapling, as shown in FIG. 3C, the first stopper 44 descends to a position opposed to the upstream end of the booklet S2. The first stopper 44 then moves toward a side of the second stopper 45 along the depth direction D. This allows the first stopper 44 to push out the booklet S2 so that the booklet S2 is moved from the sheet-stacking portion 40 to the booklet-conveying portion 43. In this moment, the second stopper 45 positions the booklet S2 by pushing the booklet S2 against the second stopper 45. The booklet-conveying portion 43 receives the booklet S2 from the sheet-stacking portion 40 to convey the booklet S2 to a position below a booklet-holding mechanism 51 of the combined processing portion 37.

(Configuration Example of Combined Processing Portion)

Figure 4:
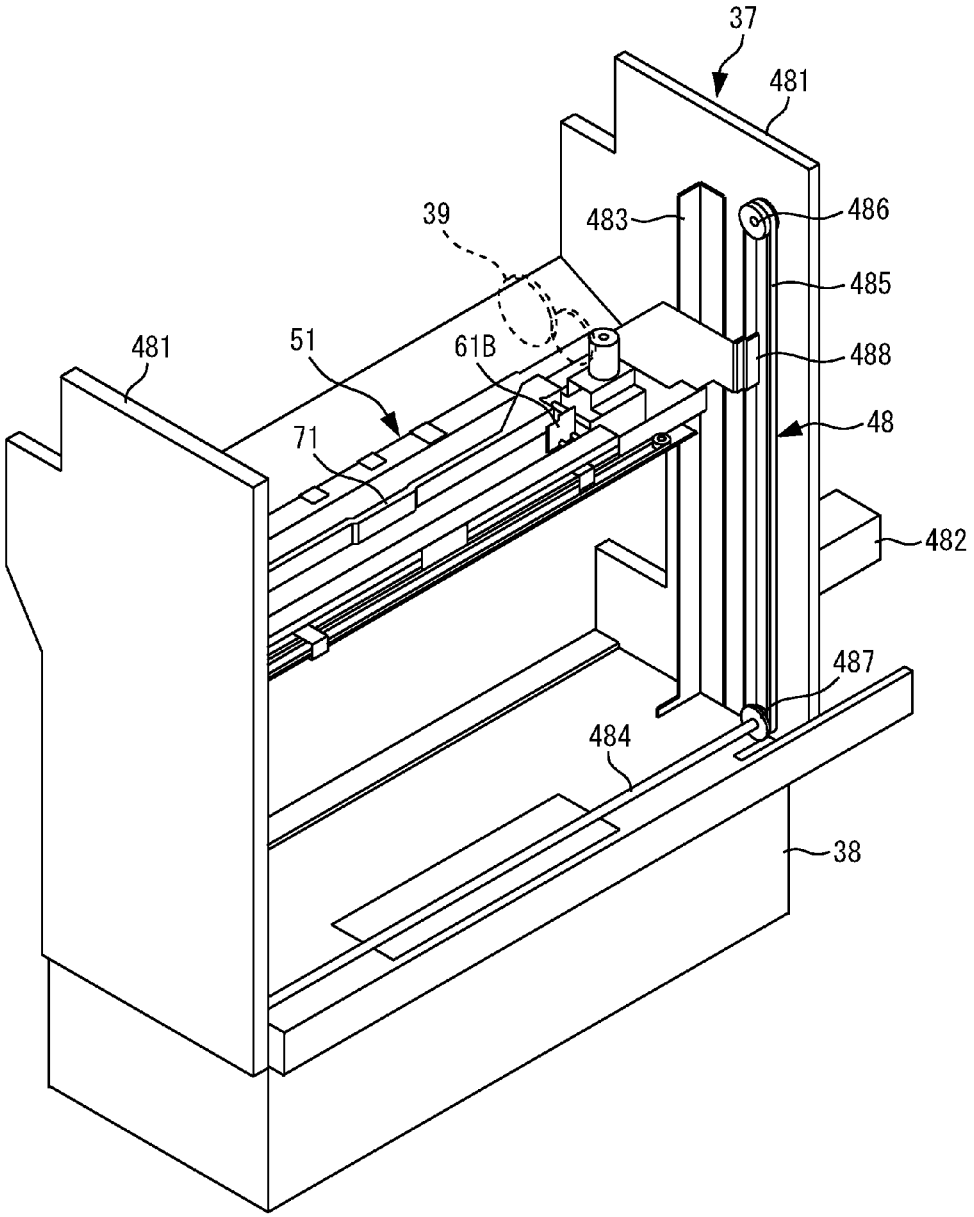
FIG. 4 is a perspective view of a combined processing portion showing a configuration example thereof.

The following will describe a configuration example of the combined processing portion 37. FIG. 4 shows a configuration example of the combined processing portion 37. As shown in FIG. 4, the combined processing portion 37 contains the booklet-holding mechanism 51, an elevating mechanism 48, a cut-off processing portion 38 which is a cut-off processing portion, a discharging portion 39 which discharges the booklet S2.

The booklet-holding mechanism 51 receives the booklet S2 from the booklet-conveying portion 43 (see FIGS. 1 and 3A through 3C) and holds the booklet S2 to perform any flattening processing on the back portion of the held booklet S2. The booklet-holding mechanism 51 will be described more in detail later.

The elevating mechanism 48, which is a moving portion, elevates the booklet-holding mechanism 51 including a flattening unit 55 operating together with a conveyance of the booklet S2. In other words, the elevating mechanism 48 supports the booklet-holding mechanism 51 as to be elevatable. The discharging portion 39 is positioned at a higher level than that of the elevating mechanism 48 and the cut-off processing portion 38 is positioned at a lower level than that of the elevating mechanism 48. The elevating mechanism 48 contains a pair of frames 481 and a driving motor 482 for elevation.

The pair of frames 481 respectively has first rotatable pulleys 486 at upper portions of their inner sides. The pair of frames 481 also respectively has second rotatable pulleys 487 at lower portions of their inner sides. The second rotatable pulleys 487 mounted on the frames 481 are connected to each other through a drive transmission shaft 484.

A timing belt 485, which is an endless belt, is stretched to be laid over the first and second pulleys 486, 487. A coupling portion 488 is fixed to the timing belt 485. The booklet-holding mechanism 51 is fixed to the coupling portion 488.

The driving motor 482 for elevation, which is a third driving portion, drives the elevating mechanism 48. The driving motor 482 for elevation is mounted on one of the pair of frames 481. A transmission mechanism, not shown, for transmitting any rotational driving power of the driving motor 482 for elevation to the first pulley 486 is provided between the driving motor 482 for elevation and the first pulley 486 mounted on the one of the frames 481. The pair of frames 481 has guide rails 483 for guiding the elevation of the booklet-holding mechanism 51 at their inner sides.

The cut-off processing portion 38 cuts off the booklet S2 held by the booklet-holding mechanism 51. Particularly, the cut-off processing portion 38 cuts off an edge of the booklet S2, which is opposed to the back portion of the booklet S2, using a cut-off blade, not shown. Hereinafter, the edge of the booklet S2, which is opposed to the back portion of the booklet S2, will be referred to as "the edge of the booklet S2".

(Configuration Example of Booklet-Holding Mechanism)

Figure 5:
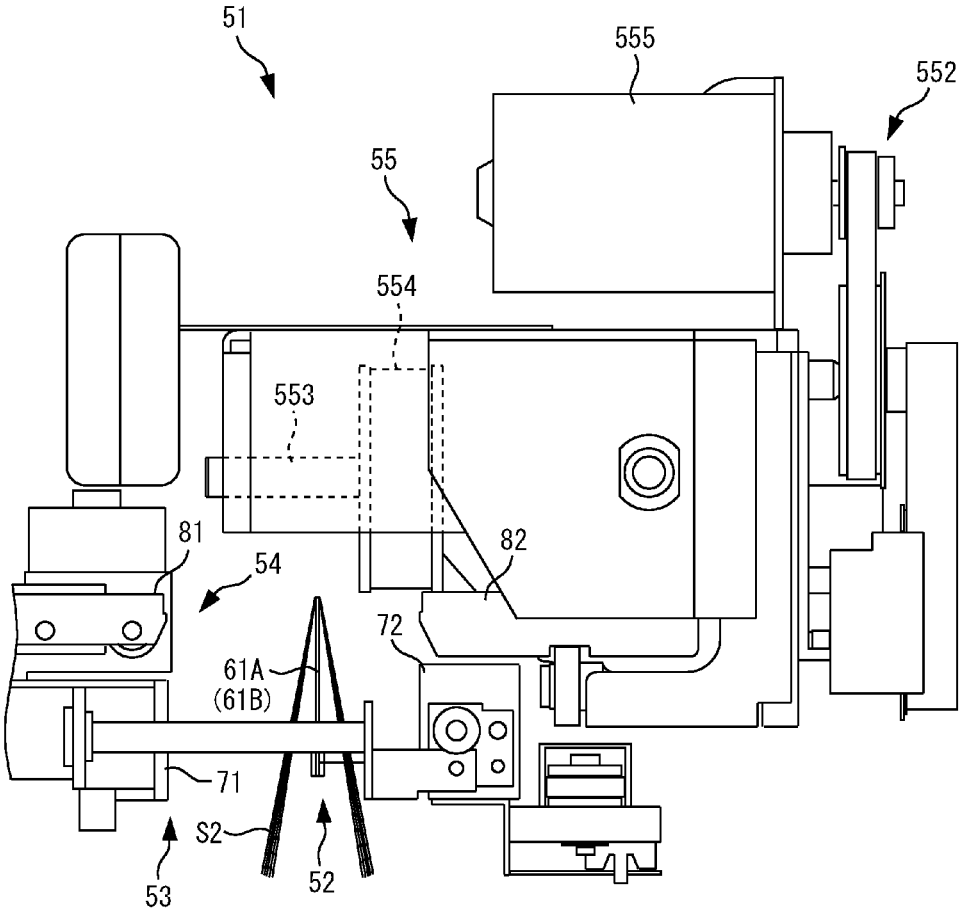
FIG. 5 is a side view of a booklet-holding mechanism showing a configuration example thereof.
Figure 6:
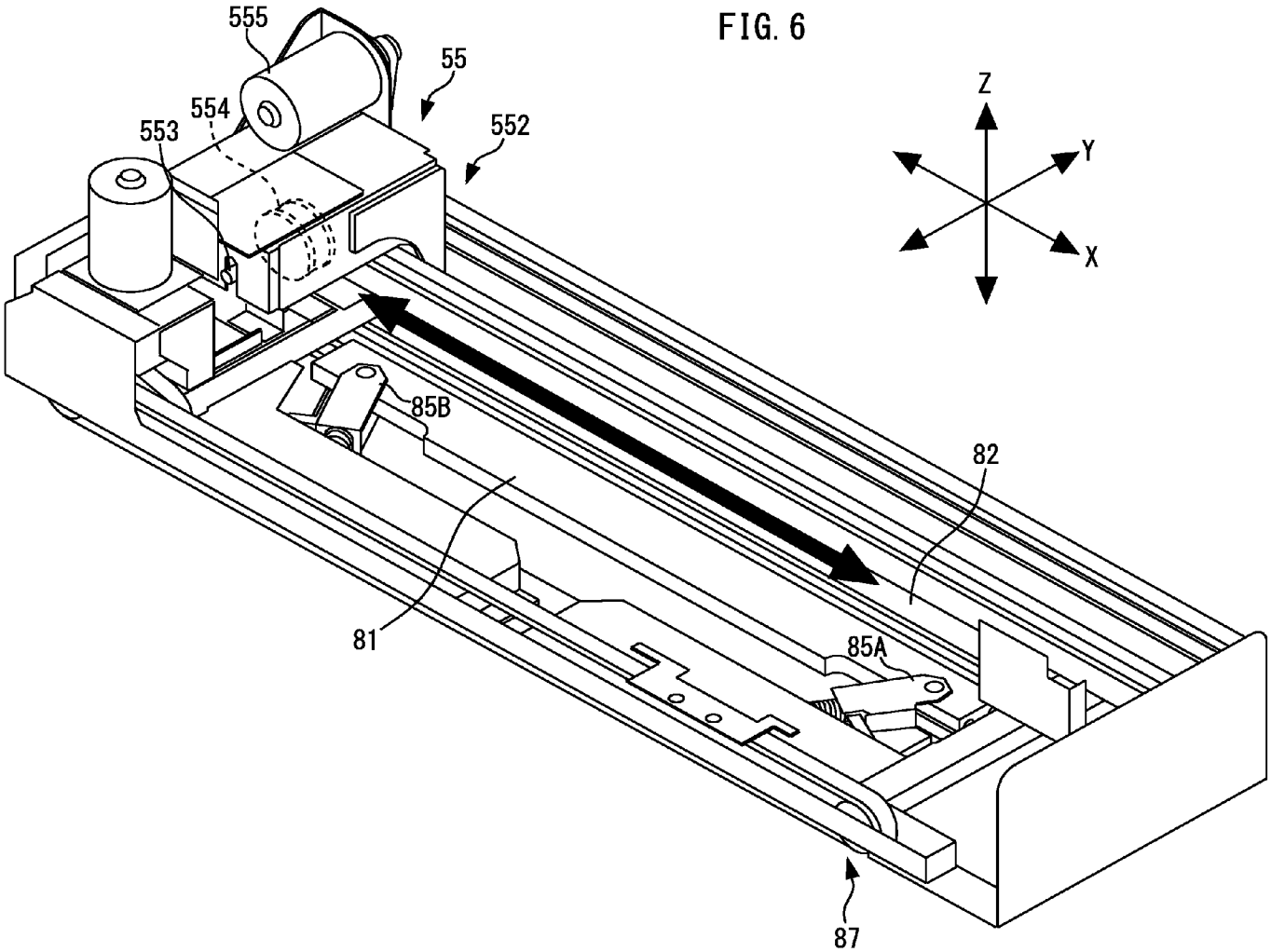
FIG. 6 is a perspective view of a flattening unit showing a configuration example thereof.
Figure 7A:
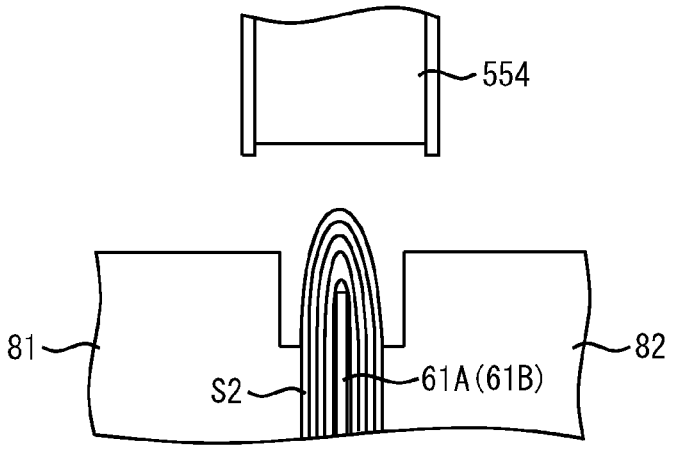
FIG. 7A is a diagram illustrating a flattening processing.
Figure 7B:
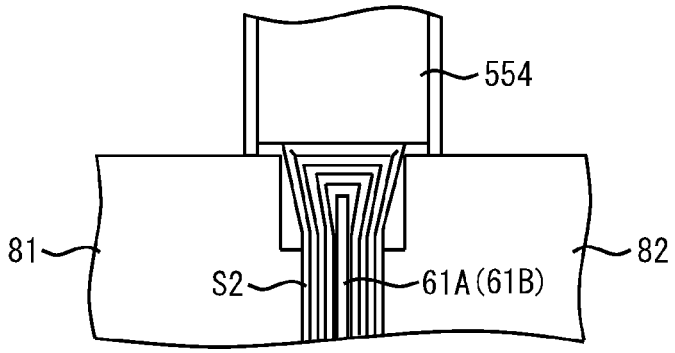
FIG. 7B is a diagram illustrating the flattening process.

The following will describe a configuration example of the booklet-holding mechanism 51. FIG. 5 shows an example of principle components of the booklet-holding mechanism 51. FIG. 6 shows a configuration example of the flattening unit 55. FIG. 7A shows a situation of the booklet S2 before the flattening unit 55 flattens the back portion of the booklet S2. FIG. 7B shows a situation of the booklet S2 after the flattening unit 55 flattens the back portion of the booklet S2.

As shown in FIGS. 5 and 6, the booklet-holding mechanism 51 contains a booklet-positioning unit 52 that positions (adjusts) the booklet S2, a first holding unit 53 and a second holding unit 54 that hold the booklet S2, and the flattening unit 55.

The booklet-positioning unit 52 is positioned between the pushing member 71 constituting the first holding unit 53 and a receiving member 72 as to be movable. The booklet-positioning unit 52 is composed of a pair of plane supporting plates 61A, 61B. The pair of supporting plates 61A, 61B moves the booklet S2 by its own weight to the suitable position even when the folded portion of the booklet S2 is shifted from the suitable position. Thus, the supporting plates 61A, 61B support the folded portion of the booklet S2 to position the folded portion of the booklet S2 to a suitable position thereof.

The first holding unit 53 contains the pushing member 71 and the receiving member 72, as shown in FIG. 5. The first holding unit 53 holds the booklet S2 positioned by the booklet-positioning unit 52 with it being pushed and nipped by the pushing member 71 and the receiving member 72. This allows the booklet S2 to be prevented from being shifted from a suitable position.

The second holding unit 54 is positioned above the first holding unit 53, as shown in FIG. 5. The second holding unit 54 performs the flattening processing on the back portion of the booklet S2 positioned by the booklet-positioning unit 52.

The second holding unit 54 contains a pushing member 81, a receiving member 82, rotatable arms 85A, 85B, and a driving mechanism 87 composed of plural pulleys, belts or the like. The second holding unit 54 holds the booklet S2 with it being pushed by the pushing member 81 and the receiving member 82 by elastically moving the rotatable arms 85A, 85B toward a side of the receiving member 82 based on the driving of the driving mechanism 87 to attach the pushing member 81 to the receiving member 82.

The flattening unit 55, which is flattening portion, flattens the back portion of the booklet S2. The flattening unit 55 is positioned above the booklet-positioning unit 52. The flattening unit 55 moves up and down between the cut-of f processing portion 38 and the discharging portion 39 operating together with the conveyance of the booklet S2. The flattening unit 55 contains a square back roller 554, a roller moving mechanism 552 and a driving motor 555 for square-back-roller, as shown in FIGS. 5 and 6.

The square back roller 554 has at least a roller width that is larger than a width of the back portion of the booklet S2. A shaft 553 supports the square back roller 554 as to be rotatable. The square back roller 554 may be fixed to the shaft 553. The square-back-roller driving motor 555, which is a first driving portion, drives the flattening unit 55. The driving motor 555 for square-back-roller connects the roller moving mechanism 552 via a transmission mechanism such as gears.

The roller moving mechanism 552 is composed of, for example, plural pulleys, a conveying belt, slider and the like. The roller moving mechanism 552 moves along a direction X (shown by an arrow in FIG. 6) by driving the driving motor 555 for square-back-roller. The square back roller 554 reciprocatively moves along the back portion of the booklet S2 on the direction X (arrow direction) together with the movement of the roller moving mechanism 552. This allows the curved back portion of the booklet S2 to be flattened by any reciprocation movement of the square back roller 554 to form the squared back portion of the booklet S2.

(Configuration Example of Post-processing Apparatus)

Figure 8:
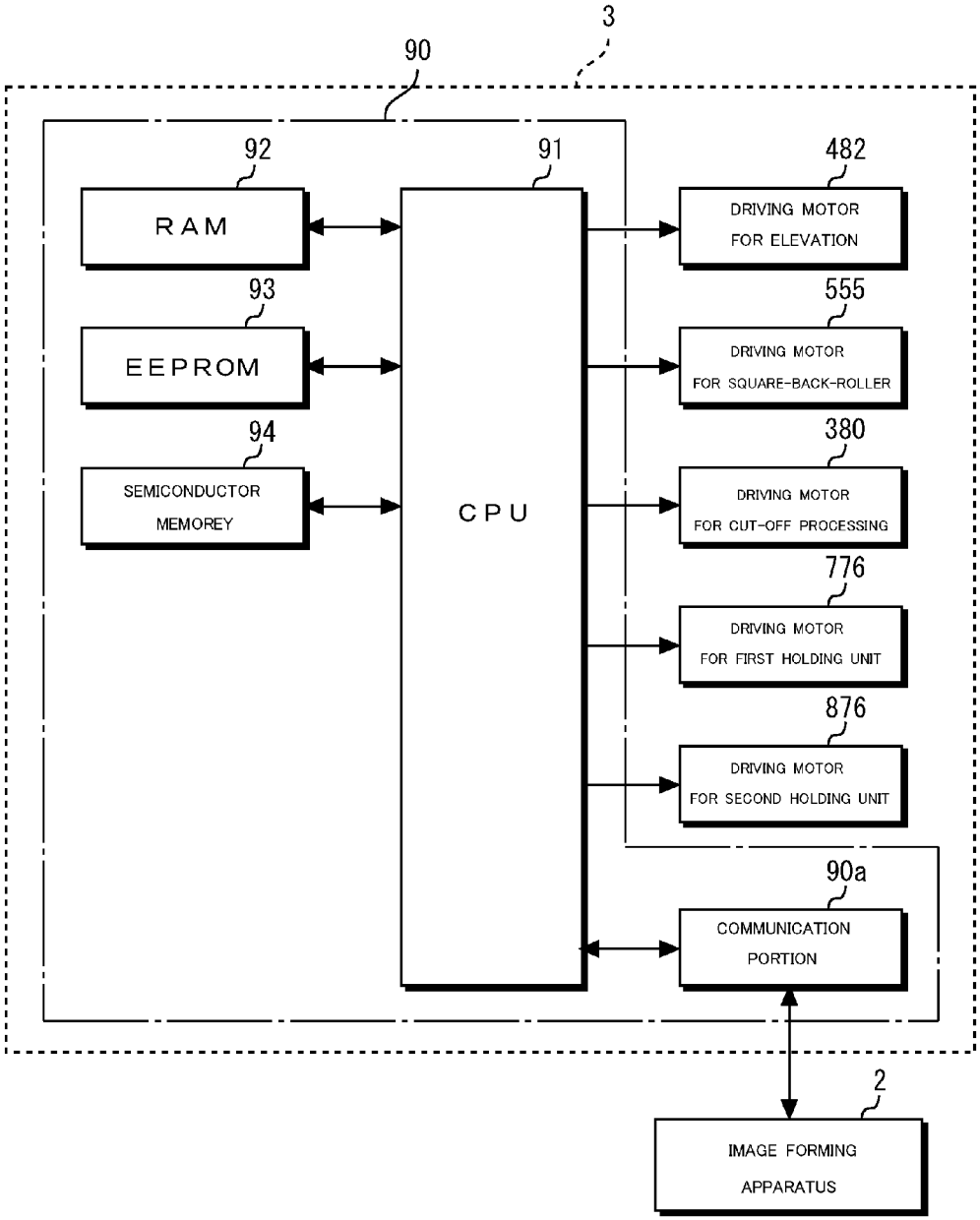
FIG. 8 is a block diagram of the post-processing apparatus showing a configuration example thereof.

The following will describe the post-processing control portion 90 in the post-processing apparatus 3. The post-processing control portion 90 controls the flattening unit 55 (flattening portion) to perform the flattening processing on the back portion of the booklet S2 while the elevating mechanism 48 conveys the booklet S2. The post-processing control portion 90 also controls the cut-off processing portion 38 to cut off the edge of the booklet S2 during the flattening processing by the flattening unit 55. FIG. 8 shows a configuration example of the post-processing control portion 90. As shown in FIG. 8, the post-processing control portion 90 contains a central processing unit (hereinafter, referred to as "CPU") 91, a random access memory (hereinafter, referred to as "RAM") 92, an electrically erasable programmable read only memory (hereinafter, referred to as "EEPROM") 93, a semiconductor memory 94 and a communication portion 90*a*.

The CPU 91 controls whole operations of the post-processing apparatus 3. RAM. 92 is used as a working area of the CPU 91. The EEPROM 93 stores control programs or the like to be carried out by the CPU 91.

The communication portion 90*a* functions as an interface and communication means to communicate with the communication portion 15*a* in the image forming apparatus 2 through a predetermined communication protocol. The communication protocol includes TCP, UDP, any serial communication and the like. The communication portion 90*a* sends and/or receives any input signals, any control signals and data from and/or to the communication portion 15*a* in the image forming apparatus 2 based on any instructions from the CPU 91.

The semiconductor memory 94 is nonvolatile storage means such as flash memory. The semiconductor memory 94 stores a table(s) using for a determination of position of the supporting plates 61A, 61B, various kinds of programs, and data about the thickness of the booklet S2 obtained by a booklet thickness detection sensor. The CPU 91 read any programs out of the EEPROM 93 or the semiconductor memory 94 to store the read programs on RAM 92 and carry out the programs. For example, the CPU 91 carries out the programs stored on the RAM 92 to perform driving control on a driving source for third driving portion.

The CPU 91 connects the driving motor 482 for elevation, the driving motor 555 for square-back-roller, a driving motor 380 for cutting-off processing, a driving motor 776 for the first holding unit and a driving motor 876 for the second holding unit, respectively. The driving motor 482 for elevation is composed of, for example, a brush motor, a stepping motor and the like. The driving motor 482 for elevation drives based on a driving signal received from the CPU 91 to move the elevating mechanism 48 up and down.

The driving motor 555 for square-back-roller is composed of, for example, a brush motor, a stepping motor and the like. The driving motor 555 for square-back-roller drives based on a driving signal received from the CPU 91 to move the roller moving mechanism 552 along the direction X.

The driving motor 380 for cutting-off processing, which is a second driving portion, drives the cut-off processing portion 38. The driving motor 380 for cutting-off processing is composed of, for example, a brush motor, a stepping motor and the like. The driving motor 380 for cutting-off processing drives based on a driving signal received from the CPU 91 to move a cut-off blade constituting the cut-off processing portion 38.

The driving motor 776 for the first holding unit is composed of, for example, an AC motor, a DC motor and the like. The driving motor 776 for the first holding unit drives based on a driving signal received from the CPU 91 to allow the booklet S2 to be held by the pushing member 71 and the receiving member 72 with the booklet S2 being pushed between the pushing member 71 and the receiving member 72. The driving motor 876 for the second holding unit is composed of, for example, an AC motor, a DC motor and the like. The driving motor 876 for the second holding unit drives based on a driving signal received from the CPU 91 to allow the booklet S2 to be held by the pushing member 81 and the receiving member 82 with the booklet S2 being pushed between the pushing member 81 and the receiving member 82.

(Operation Example of Booklet-Holding Mechanism)

The following will describe an operation example of the booklet-holding mechanism 51 briefly. FIGS. 9A through 9D show the operation example of the booklet-holding mechanism 51 when performing the flattening processing and the cut-off processing. It is to be noted that FIGS. 9A through 9D schematically show the booklet-holding mechanism 51 shown in FIGS. 4 through 6 and the like.

Figure 9A:
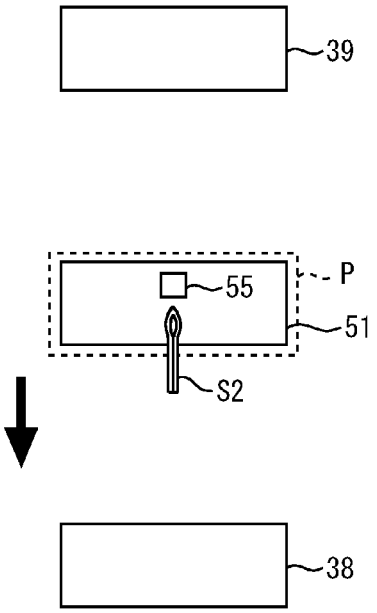
FIG. 9A is a diagram showing an operation example (Part one) of the booklet-holding mechanism.

As shown in FIG. 9A, when the booklet-holding mechanism 51 standing by at a booklet-receiving position p receives the booklet S2, the second holding unit 54 holds the received booklet S2 and then, the booklet-holding mechanism 51 descends to the cut-off processing portion 38. The flattening unit 55 also descends together with the conveyance of the booklet S2 and flattens the back portion of the booklet S2 during the conveyance of the booklet S2 to the cut-off processing portion 38.

Figure 9C:
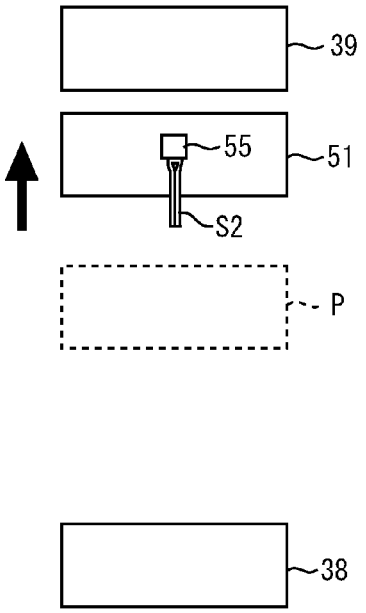
FIG. 9C is a diagram showing an operation example (Part three) of the booklet-holding mechanism.
Figure 9B:
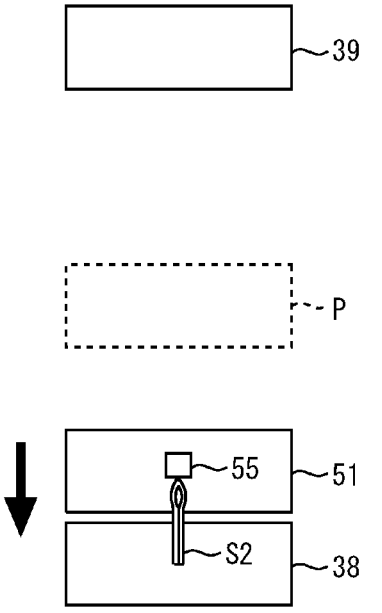
FIG. 9B is a diagram showing an operation example (Part two) of the booklet-holding mechanism.

As shown in FIG. 9B, when the booklet-holding mechanism 51 reaches the cut-off processing portion 38, the cut-off processing portion 38 cuts off the edge of the booklet S2 held by the booklet-holding mechanism 51. When the cut-off of the edge of the booklet S2 is complete, the booklet-holding mechanism 51 ascends toward the discharging portion 39 as shown in FIG. 9C. The flattening unit 55 flattens the back portion of the booklet S2 during the cut-off processing of the edge of the booklet S2 and the ascent of the booklet-holding mechanism 51 toward the discharging portion 39.

Figure 9D:
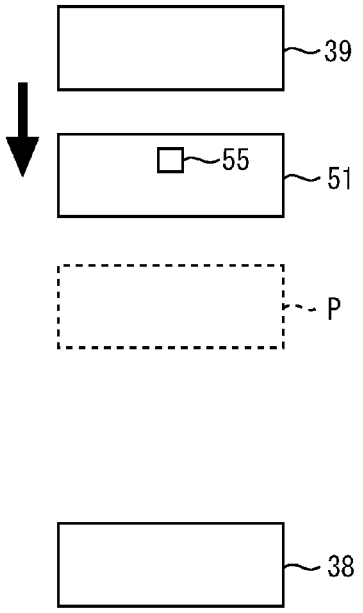
FIG. 9D is a diagram showing an operation example (Part four) of the booklet-holding mechanism.

When the booklet-holding mechanism 51 reaches the discharging portion 39, the booklet S2 held by the booklet-holding mechanism 51 is discharged from the discharging portion 39 to outside. When the flattening processing is not complete, the discharging processing is not performed. When the booklet-holding mechanism 51 discharges the booklet S2, the booklet-holding mechanism 51 descends to the booklet-receiving position p as shown in FIG. 9D. The booklet-holding mechanism 51 stops when it reaches the booklet-receiving position p (see FIG. 9A). The booklet-holding mechanism 51 then receives a next conveyed booklet S2.

(Operation Example of Image Forming System)

Figure 10A:
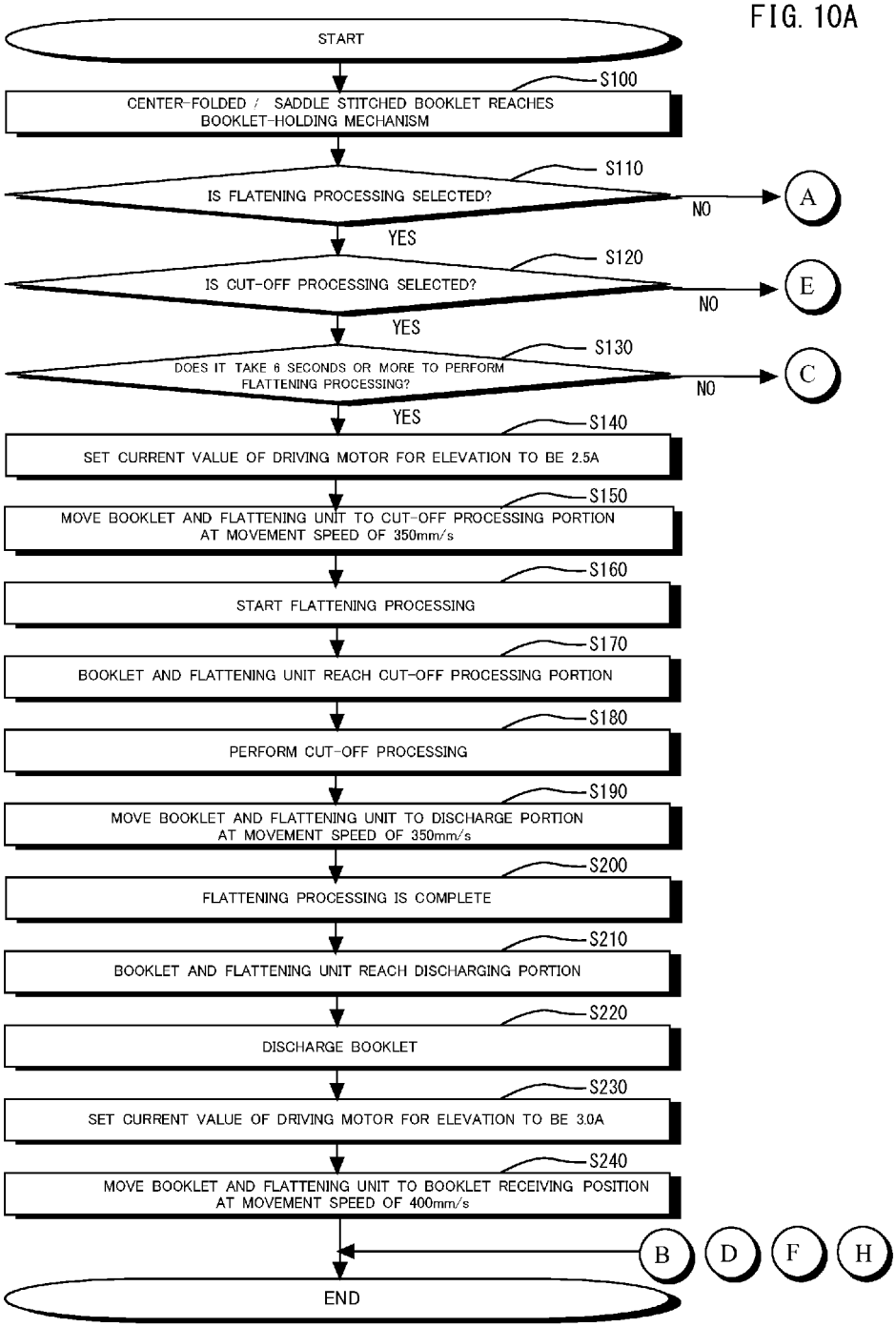
FIG. 10A is a flowchart showing an operation example of the image forming system when the system performs the post-processing (Part one)

The following will describe an operation example of the image forming system 1 according to the invention. FIGS. 10A through 11 show the operation example of the image forming system 1. A case where the image forming control portion 15 of the image forming apparatus 2 is mainly used to perform the image forming processing and the post-processing operating together with the communication to the post-processing control portion 90 of the post-processing apparatus 3 will be described. In other words, either the image forming control portion 15 of the image forming apparatus 2 or the post-processing control portion 90 of the post-processing apparatus 3 may control the operation of the image forming system 1. It is estimated in this example that a period of time from the moment when the prior booklet S2 has been flattened, cut off and discharged until the moment when the subsequent booklet S2 is received is set to be, for example, 10 seconds.

As shown in FIG. 10A, at a step S100, the center-fording processing and the saddle stitching processing are performed on the plural sheets of paper S1 conveyed from the image forming apparatus 2 to form the booklet S2. The booklet-conveying portion 43 conveys the booklet S2 to the booklet-holding mechanism 51 (flattening unit 55).

At a step S110, the image forming control portion 15 of the image forming apparatus 2 determines if the user selects an item, "flattening" on a manipulation screen of the manipulation and display portion 14. If the image forming control portion 15 of the image forming apparatus 2 determines that the item, "flattening" is selected on the manipulation screen of the manipulation and display portion 14, it goes to a step S120. If the image forming control portion 15 of the image forming apparatus 2 does not determine that the item, "flattening" is selected on the manipulation screen of the manipulation and display portion 14, it goes to a step S510 shown in FIG. 11. In this moment, the post-processing control portion 90 may control the elevating mechanism 48 so as to change a moving speed of the elevating mechanism 48 based on whether or not the flattening unit 55 performs the flattening processing. Further, the post-processing control portion 90 may change a current value of the driving motor 482 for elevation based on whether or not the flattening unit 55 performs the flattening processing.

At the step S120, the image forming control portion 15 of the image forming apparatus 2 determines if the user selects an item, "cut-off processing" on a manipulation screen of the manipulation and display portion 14. If the image forming control portion 15 of the image forming apparatus 2 determines that the item, "cut-off processing" is selected on the manipulation screen of the manipulation and display portion 14, it goes to a step S130. If the image forming control portion 15 of the image forming apparatus 2 does not determine that the item, "cut-off processing" is selected on the manipulation screen of the manipulation and display portion 14, it goes to a step S350 shown in FIG. 10C. In this moment, the post-processing control portion 90 may control the elevating mechanism 48 so as to change a moving speed of the elevating mechanism 48 based on whether or not the cut-off processing portion 38 performs the cut-off processing. Further, the post-processing control portion 90 may change a current value of the driving motor 380 for cut-off processing based on whether or not the cut-off processing portion 38 performs the cut-off processing.

At the step S130, the image forming control portion 15 of the image forming apparatus 2 determines if it takes 6 seconds or more to perform the flattening processing. A period of flattening time is suitably selected based on an extent of flattening the back portion of the booklet S2. For example, when the user desires to make the back portion of the booklet S2 squared precisely, plural times of the flattening processing are required so that 6 seconds or more are selective about the period of flattening time. If 6 seconds or more are selective about the period of flattening time, the image forming control portion 15 of the image forming apparatus 2 goes to a step S140. In this moment, the post-processing control portion 90 may control the elevating mechanism 48 so as to change a moving speed of the elevating mechanism 48 based on a period of time when the flattening unit 55 performs the flattening processing. Further, the post-processing control portion 90 may change a current value of the driving motor 482 for elevation based on the period of time when the flattening unit 55 performs the flattening processing.

On the other hand, when the user desires to make the back portion of the booklet S2 squared to some extent or to shorten the period of flattening time for improving any productivity thereof, less than 6 seconds are selective about the period of flattening time. If less than 6 seconds are selective about the period of flattening time, the image forming control portion 15 of the image forming apparatus 2 goes to a step S250 shown in FIG. 10B.

If 6 seconds or more are selective about the period of flattening time, at the step S140, the image forming control portion 15 of the image forming apparatus 2 selects a current value of the driving motor 482 for elevation, which drives the elevating mechanism 48, as to be 2.5 A. When the period of flattening time is set to become longer such as 6 seconds or more, the booklet S2 cannot be discharged until the flattening processing is complete even if the booklet S2 reaches the discharging portion 39. Accordingly, this example sets the current value of the driving motor 482 for elevation to be smaller than that in a case where the period of flattening time is set to be less than 6 seconds. This allows the movement speed of the booklet-holding mechanism 51 to be decreased. Accordingly, in this example, the image forming control portion 15 of the image forming apparatus 2 may controls the booklet-holding mechanism 51 to reach the discharging portion 39 until the flattening processing is complete. This may reduce any consumed electric power of the driving motor 482 for elevation and the like.

At a step S150, the image forming control portion 15 of the image forming apparatus 2 controls the booklet-holding mechanism 51 holding the booklet S2 to move to the cut-off processing portion 38 at a movement speed of 350 mm/s by supplying the set current value of 2.5 A to the driving motor 482 for elevation. The flattening unit 55 also moves to the cut-off processing portion 38 at a movement speed of 350 mm/s together with the movement of the booklet-holding mechanism 51.

At a step S160, the image forming control portion 15 of the image forming apparatus 2 controls the flattening unit 55 to start the flattening process while the booklet-holding mechanism 51 moves to the cut-off processing portion 38. The CPU 91 drives the driving motor 555 for square-back-roller to reciprocatively move the roller moving mechanism 552 along the direction X. The square back roller 554 also reciprocatively moves along the direction X together with the movement of the roller moving mechanism 552. This allows the back portion of the booklet S2 to be flattened.

At a step S170, the booklet-holding mechanism 51 including the flattening unit 55 reaches the cut-off processing portion 38. At a step S180, the image forming control portion 15 of the image forming apparatus 2 controls the cut-off processing portion 38 to perform the cut-off processing when the booklet-holding mechanism 51 reaches the cut-off processing portion 38. Specifically, the CPU 91 drives the driving motor 380 for cutting-off processing to cut off the edge of the booklet S2 by the cut-off blade so as to make ends of the sheets of paper S1 flush with each other. In this example, the flattening processing is performed during the cut-off processing so that the flattening processing and the cut-off processing are performed at the same time.

Figure 12A:
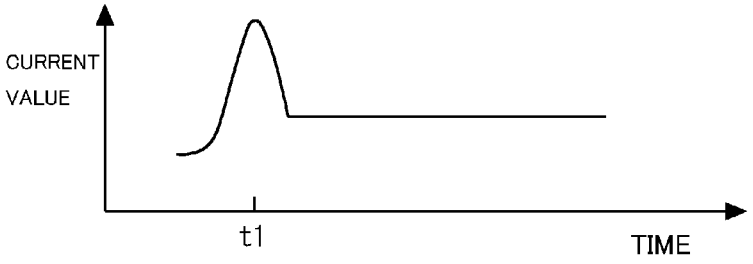
FIG. 12A is a graph showing a current waveform of a driving motor for square-back-roller when the driving motor for square-back-roller and a driving motor for cutting-off processing start at the same time.
Figure 12B:
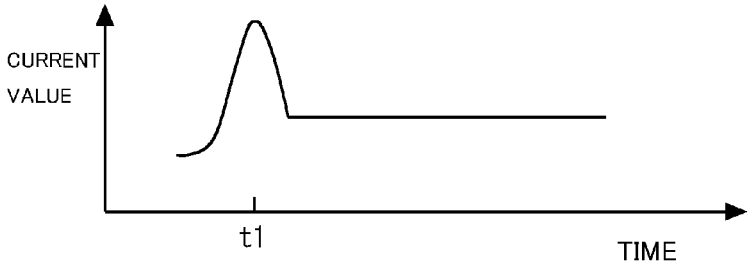
FIG. 12B is a graph showing the current waveform of the driving motor for cutting-off processing when the driving motor for square-back-roller and a driving motor for cutting-off processing start at the same time.
Figure 12C:
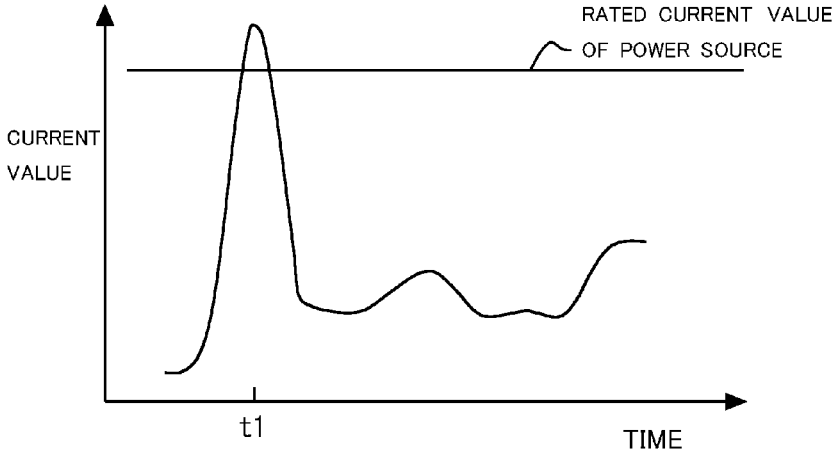
FIG. 12C is a graph showing a synthetic current waveform of the driving motor for square-back-roller and the driving motor for cutting-off processing when the driving motor for square-back-roller and the driving motor for cutting-off processing start at the same time.

Here, the following will describe a control example of the start timings of the driving motor 555 for square-back-roller and the driving motor 380 for cutting-off processing in a case of performing the flattening processing and the cut-off processing at the same time. Here, the post-processing control portion 90 may control the driving motor 555 for square-back-roller and the driving motor 380 for cutting-off processing, respectively, so that the start timing of the driving motor 555 for square-back-roller is different from that of the driving motor 380 for cutting-off processing. FIG. 12A shows a current waveform of the driving motor 555 for square-back-roller when the driving motor 555 for square-back-roller and the driving motor 380 for cutting-off processing start at the same time. FIG. 12B shows the current waveform of the driving motor 380 for cutting-off processing when the driving motor 555 for square-back-roller and the driving motor 380 for cutting-off processing start at the same time. FIG. 12C shows a synthetic current waveform of the driving motor 555 for square-back-roller and the driving motor 380 for cutting-off processing when the driving motor 555 for square-back-roller and the driving motor 380 for cutting-off processing start at the same time. In each of the respective FIGS. 12A through 12C, a vertical axis indicates current value and a horizontal axis indicates time.

As shown in FIGS. 12A through 12C, when a brush motor with large power consumption is used for the driving motor 555 for square-back-roller and the driving motor 380 for cutting-off processing, respectively, if the driving motor 555 for square-back-roller and the driving motor 380 for cutting-off processing start at the same time t1, the start current of their motors may exceed a rated current value of the power source thereof because of an overlap of the start timings of their motors.

Figure 13A:
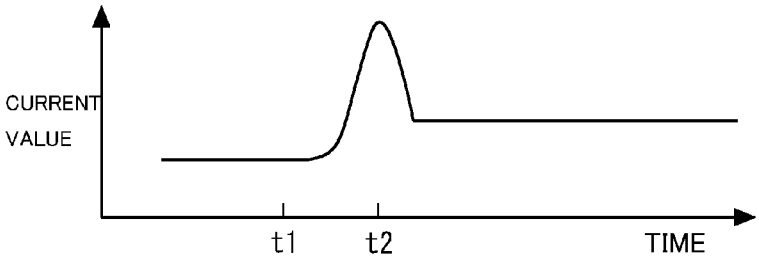
FIG. 13A is a graph showing a current waveform of the driving motor for square-back-roller when the driving motor for square-back-roller and the driving motor for cutting-off processing start with their starting timings being shifted.
Figure 13B:
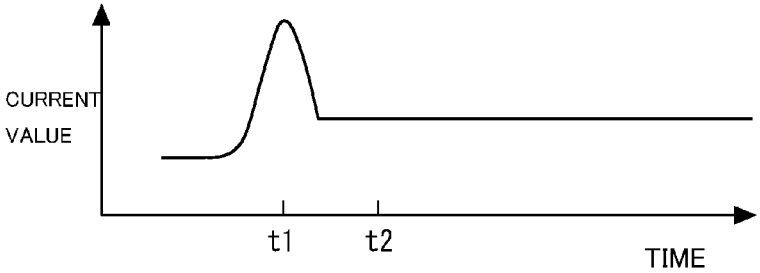
FIG. 13B is a graph showing a current waveform of the driving motor for cutting-off processing when the driving motor for square-back-roller and the driving motor for cutting-off processing start with their starting timings being shifted.
Figure 13C:
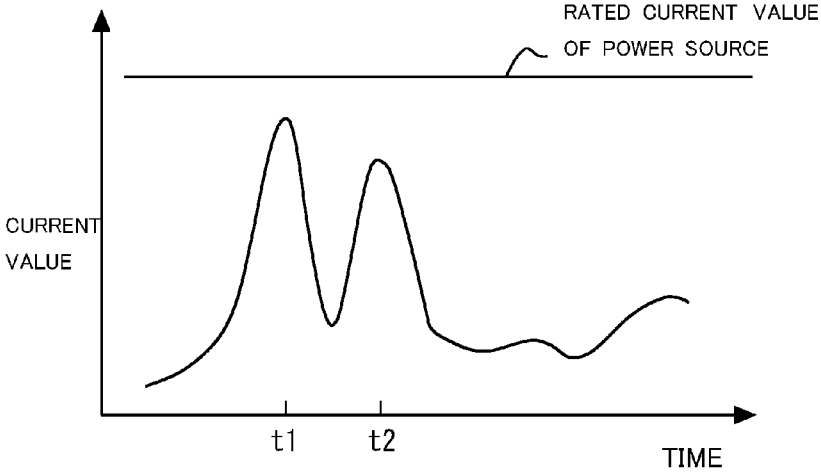
FIG. 13C is a graph showing a synthetic current waveform of the driving motor for square-back-roller and the driving motor for cutting-off processing when the driving motor for square-back-roller and the driving motor for cutting-off processing start with their starting timings being shifted.

Accordingly, this example prevents the start current value of their motors from exceeding the rated current value of the power source thereof by shifting the start timings of their motors. FIG. 13A shows a current waveform of the driving motor 555 for square-back-roller when the driving motor 555 for square-back-roller and the driving motor 380 for cutting-off processing start with their starting timings being shifted. FIG. 13B shows a current waveform of the driving motor 380 for cutting-off processing when the driving motor 555 for square-back-roller and the driving motor 380 for cutting-off processing start with their starting timings being shifted. FIG. 13C shows a synthetic current waveform of the driving motor 555 for square-back-roller and the driving motor 380 for cutting-off processing when the driving motor 555 for square-back-roller and the driving motor 380 for cutting-off processing start with their starting timings being shifted. In each of the respective FIGS. 13A through 13C, a vertical axis indicates current value and a horizontal axis indicates time.

As shown in FIGS. 13A through 13C, the driving motor 555 for square-back-roller stats at time t2 and the driving motor 380 for cutting-off processing starts at time t1. Thus, the start timing of the driving motor 555 for square-back-roller shifts the start timing of the driving motor 380 for cutting-off processing so that no start current of their motors may exceed the rated current value of the power source thereof. This allows current consumption to be controlled in the driving motor 555 for square-back-roller and the driving motor 380 for cutting-off processing.

Referred back to FIG. 10A, at a step S190, the image forming control portion 15 of the image forming apparatus 2 controls the booklet-holding mechanism 51 to move from the cut-off processing portion 38 to the discharging portion 39 at a movement speed of, for example, 350 mm/s by supplying the set current value of 2.5 A to the driving motor 482 for elevation when the cut-off processing portion 38 finishes the cut-off processing.

At a step S200, the image forming control portion 15 of the image forming apparatus 2 controls the flattening unit 55 to stop the flattening processing when the image forming control portion 15 determines that the set period of flattening time (6 seconds or more) elapses during the movement of the booklet-holding mechanism 51. Such flattening processing allows the back portion of the booklet S2 to be flattened.

At a step S210, the booklet-holding mechanism 51 reaches the discharging portion 39. At a step S220, the image forming control portion 15 of the image forming apparatus 2 controls the booklet-holding mechanism 51 holding the booklet S2 to discharge the booklet S2 from the discharging portion 39 to a discharging tray, not shown. In this case, if the flattening unit 55 has not yet finished the flattening processing when the booklet-holding mechanism 51 reaches the discharging portion 39, no discharging processing is performed until the flattening processing is complete.

At a step S230, the image forming control portion 15 of the image forming apparatus 2 changes the set current value of the driving motor 482 for elevation, which drives the elevating mechanism 48, from 2.5 A to 3.0 A. Changing the set current value of the driving motor 482 for elevation from 2.5 A to 3.0 A is because the booklet-holding mechanism 51 must move to the booklet receiving position P surely until the next booklet S2 reaches the booklet receiving position P (for 10 seconds).

At a step S240, the image forming control portion 15 of the image forming apparatus 2 controls the booklet-holding mechanism 51 to move to the booklet receiving position P at a movement speed of, for example, 400 mm/s by supplying the set current value of 3.0 A to the driving motor 482 for elevation. This allows the booklet-holding mechanism 51 to return to the booklet receiving position P before the next booklet S2 reaches the booklet receiving position P.

Figure 10B:
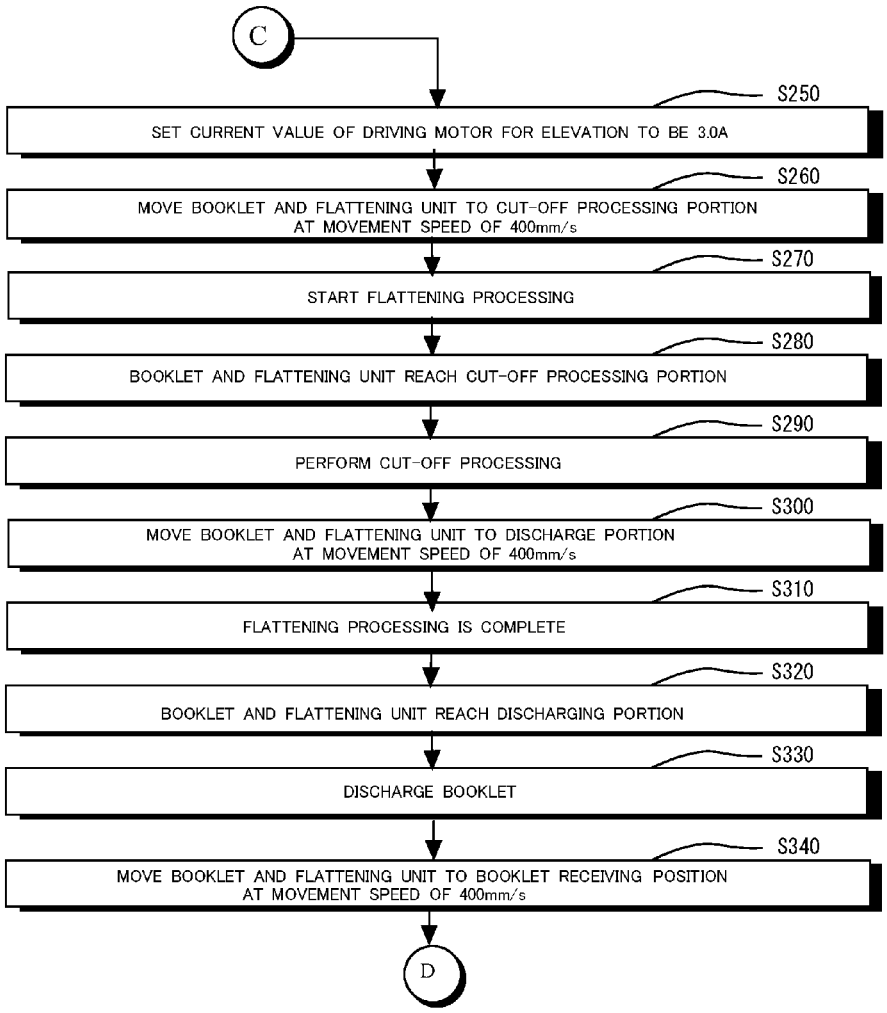
FIG. 10B is a flowchart showing the operation example of the image forming system when the system performs the post-processing (Part two)
Figure 11:
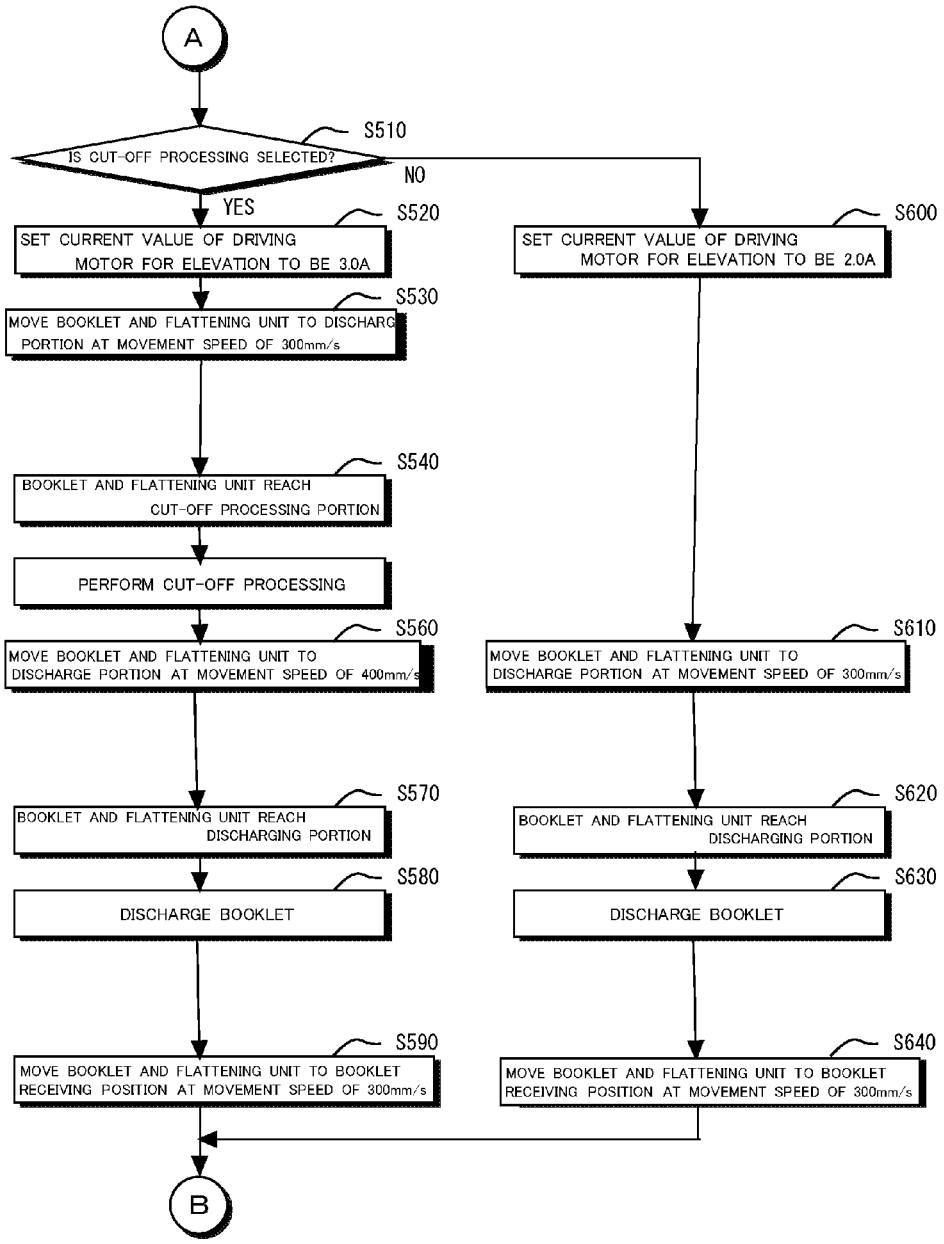
FIG. 11 is a flowchart showing the operation example of the image forming system when the system performs the post-processing (Part five)

On the other hand, when the image forming control portion 15 of the image forming apparatus 2 selects less than 6 seconds to perform the flattening processing at the step S130, at the step S250 shown in FIG. 10B, the image forming control portion 15 of the image forming apparatus 2 selects a current value of the driving motor 482 for elevation to be 3.0 A. Selecting the set current value to be 3.0 A is because the booklet-holding mechanism 51 is required to move more rapidly as compared with the case of the period of flattening time of 6 seconds or more.

At a step S260, the image forming control portion 15 of the image forming apparatus 2 controls the booklet-holding mechanism 51 holding the booklet S2 to move to the cut-off processing portion 38 at a movement speed of 400 mm/s by supplying the set current value of 3.0A to the driving motor 482 for elevation. The flattening unit 55 also moves to the cut-off processing portion 38 at a movement speed of 400 mm/s together with the movement of the booklet-holding mechanism 51.

At a step S270, the image forming control portion 15 of the image forming apparatus 2 controls the flattening unit 55 to start the flattening process while the booklet-holding mechanism 51 moves to the cut-off processing portion 38. The CPU 91 drives the driving motor 555 for square-back-roller to reciprocatively move the roller moving mechanism 552 along the direction X. The square back roller 554 also reciprocatively moves along the direction X together with the movement of the roller moving mechanism 552. This allows the back portion of the booklet S2 to be flattened.

At a step S280, the booklet-holding mechanism 51 including the flattening unit 55 reaches the cut-off processing portion 38. At a step S290, the image forming control portion 15 of the image forming apparatus 2 controls the cut-off processing portion 38 to perform the cut-off processing. In this example, during the cut-off processing, the flattening unit 55 continues performing the flattening processing. It is to be noted that as described with reference to FIGS. 13A through 13C, when the flattening processing and the cut-off processing are performed at the same time, it is prefer to control the start timings of the motors so that the start timing of the driving motor 555 for square-back-roller in the flattening processing shifts the start timing of the driving motor 380 in the cutting-off processing.

At a step S300, the image forming control portion 15 of the image forming apparatus 2 controls the booklet-holding mechanism. 51 to move from the cut-off processing portion 38 to the discharging portion 39 at a movement speed of, for example, 400 mm/s by supplying the set current value of 3.0 A to the driving motor 482 for elevation when the cut-off processing portion 38 finishes the cut-off processing.

At a step S310, the image forming control portion 15 of the image forming apparatus 2 controls the flattening unit 55 to stop the flattening processing when the image forming control portion 15 determines that the set period of flattening time (less than 6 seconds) elapses during the movement of the booklet-holding mechanism 51. Such flattening processing allows the back portion of the booklet S2 to be flattened.

At a step S320, the booklet-holding mechanism 51 reaches the discharging portion 39. At a step S330, the image forming control portion 15 of the image forming apparatus 2 controls the booklet-holding mechanism 51 holding the booklet S2 to discharge the booklet S2 from the discharging portion 39 to a discharging tray, not shown. In this case, if the flattening unit 55 has not yet finished the flattening processing when the booklet-holding mechanism 51 reaches the discharging portion 39, no discharging processing is performed until the flattening processing is complete.

At a step S340, the image forming control portion 15 of the image forming apparatus 2 controls the booklet-holding mechanism. 51 to move to the booklet receiving position P at a movement speed of, for example, 400 mm/s by supplying the set current value of 3.0 A to the driving motor 482 for elevation. This allows the booklet-holding mechanism 51 to return to the booklet receiving position P before the next booklet S2 reaches the booklet receiving position P. In addition, when it could afford the time to receive a next booklet S2, the driving motor 482 for elevation may drive slowly.

Figure 10C:
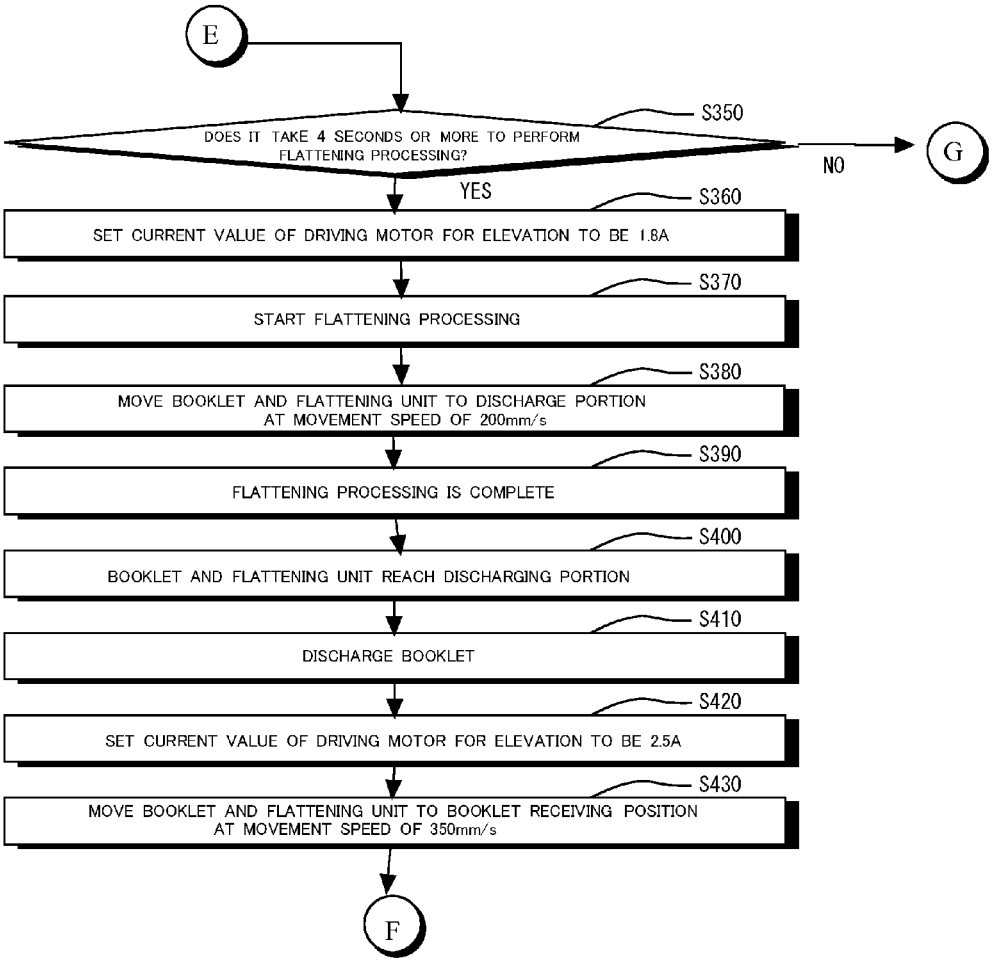
FIG. 10C is a flowchart showing the operation example of the image forming system when the system performs the post-processing (Part three)

On the other hand, if the flattening processing is selected at the step S110 and the cut-off processing is not selected at the step S120, at a step S350 shown in FIG. 10C, the image forming control portion 15 of the image forming apparatus 2 determines if it takes 4 seconds or more to perform the flattening processing. It is because no cut-off processing is performed and the booklet-holding mechanism 51 is able to directly move to the discharging portion 39 not through the cut-off processing portion 38 so that a moving distance of the booklet-holding mechanism 51 becomes shorter that the period of flattening time of this case is shorter than that of the case where both of the flattening processing and the cut-off processing are selected. If 4 seconds or more are selective about the period of flattening time, the image forming control portion 15 of the image forming apparatus 2 goes to a step S360. If less than 4 seconds are selective about the period of flattening time, the image forming control portion 15 of the image forming apparatus 2 goes to a step S440 shown in FIG. 10D.

At the step S360, when 4 seconds or more are selective about the period of flattening time, the image forming control portion 15 of the image forming apparatus 2 selects a current value of the driving motor 482 for elevation to be 1.8 A as a set current value.

At a step S370, the image forming control portion 15 of the image forming apparatus 2 controls the flattening unit 55 to start the flattening process. The CPU 91 drives the driving motor 555 for square-back-roller to reciprocatively move the roller moving mechanism 552 along the direction X. The square back roller 554 also reciprocatively moves along the direction X together with the movement of the roller moving mechanism 552. This allows the back portion of the booklet S2 to be flattened.

At a step S380, the image forming control portion 15 of the image forming apparatus 2 controls the booklet-holding mechanism. 51 (with the flattening unit 55) holding the booklet S2 to move to the discharging portion 39 at a movement speed of, for example, 200 mm/s by supplying the set current value of 1.8 A to the driving motor 482 for elevation. The image forming control portion 15 controls the flattening unit 55 to perform the flattening processing on the back portion of the booklet S2 during the movement of the booklet S2.

At a step S390, the image forming control portion 15 of the image forming apparatus 2 controls the flattening unit 55 to stop the flattening processing when the image forming control portion 15 determines that the set period of flattening time (4 seconds or more) elapses during the movement of the booklet-holding mechanism 51. Such flattening processing allows the back portion of the booklet S2 to be flattened.

At a step S400, the booklet-holding mechanism 51 reaches the discharging portion 39. At a step S410, the image forming control portion 15 of the image forming apparatus 2 controls the booklet-holding mechanism 51 holding the booklet S2 to discharge the booklet S2 from the discharging portion 39 to a discharging tray, not shown, when the booklet-holding mechanism 51 reaches the discharging portion 39.

At a step S420, the image forming control portion 15 of the image forming apparatus 2 changes the set current value of the driving motor 482 for elevation from 1.8 A to 2.5 A. Changing the current value of the driving motor 482 for elevation from 1.8 A to 2.5 A is because the booklet-holding mechanism 51 must return to the booklet receiving position P until the next booklet S2 reaches the booklet receiving position P.

At a step S430, the image forming control portion 15 of the image forming apparatus 2 controls the booklet-holding mechanism. 51 to move to the booklet receiving position P at a movement speed of, for example, 350 mm/s by supplying the set current value of 2.5 A to the driving motor 482 for elevation. This allows the booklet-holding mechanism 51 to return to the booklet receiving position P before the next booklet S2 reaches the booklet receiving position P.

Figure 10D:
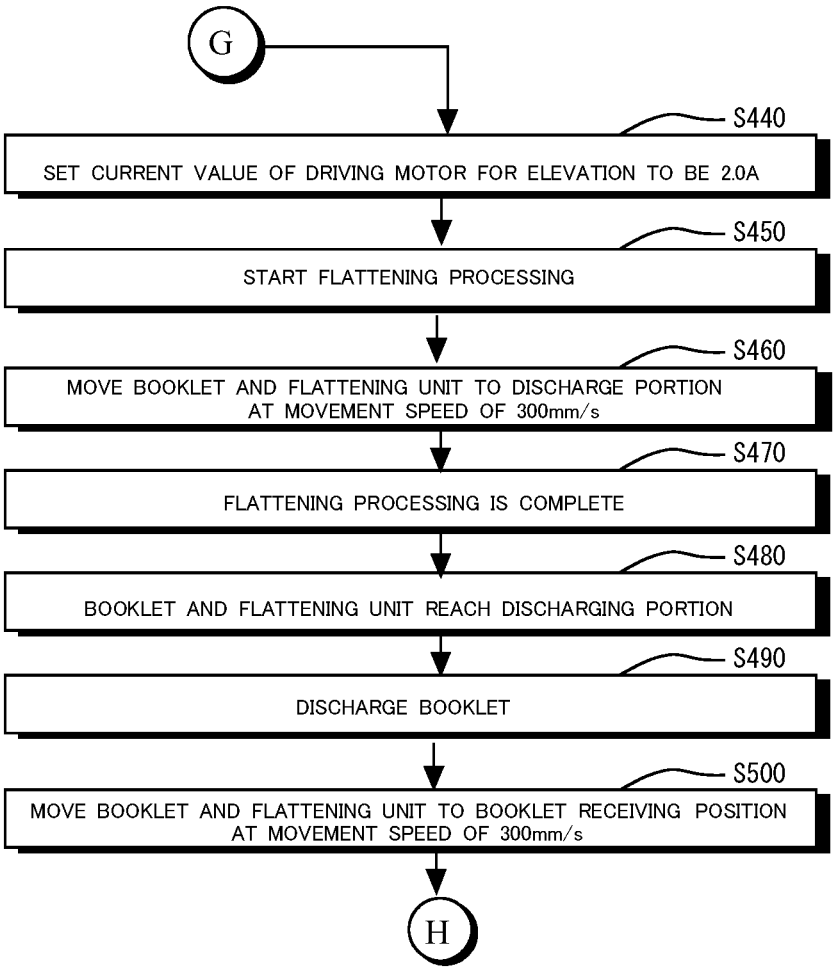
FIG. 10D is a flowchart showing the operation example of the image forming system when the system performs the post-processing (Part four)

On the other hand, if less than 4 seconds are selective about the period of flattening time at the step S350, the image forming control portion 15 of the image forming apparatus 2 selects a current value of the driving motor 482 for elevation to be 2.0 A as a set current value at the step S440 shown in FIG. 10D.

At a step S450, the image forming control portion 15 of the image forming apparatus 2 controls the flattening unit 55 to start the flattening process. The CPU 91 drives the driving motor 555 for square-back-roller to reciprocatively move the roller moving mechanism 552 along the direction X. The square back roller 554 also reciprocatively moves along the direction X together with the movement of the roller moving mechanism 552. This allows the back portion of the booklet S2 to be flattened.

At a step S460, the image forming control portion 15 of the image forming apparatus 2 controls the booklet-holding mechanism. 51 holding the booklet S2 to move to the discharging portion 39 at a movement speed of, for example, 300 mm/s by supplying the set current value of 2.0 A to the driving motor 482 for elevation. The image forming control portion 15 controls the flattening unit 55 to perform the flattening processing on the back portion of the booklet S2 during the movement of the booklet S2.

At a step S470, the image forming control portion 15 of the image forming apparatus 2 controls the flattening unit 55 to stop the flattening processing when the image forming control portion 15 determines that the set period of flattening time (less than 4 seconds) elapses during the movement of the booklet-holding mechanism 51. Such flattening processing allows the back portion of the booklet S2 to be flattened.

At a step S480, the booklet-holding mechanism 51 reaches the discharging portion 39. At a step S490, the image forming control portion 15 of the image forming apparatus 2 controls the booklet-holding mechanism 51 holding the booklet S2 to discharge the booklet S2 from the discharging portion 39 to a discharging tray, not shown, when the booklet-holding mechanism 51 reaches the discharging portion 39. In this case, if the flattening unit 55 has not yet finished the flattening processing when the booklet-holding mechanism 51 reaches the discharging portion 39, no discharging processing is performed until the flattening processing is complete.

At a step S500, the image forming control portion 15 of the image forming apparatus 2 controls the booklet-holding mechanism. 51 to move to the booklet receiving position P at a movement speed of, for example, 300 mm/s by supplying the set current value of 2.0 A to the driving motor 482 for elevation. This allows the booklet-holding mechanism 51 to return to the booklet receiving position P before the next booklet S2 reaches the booklet receiving position P.

The following will describe a case where the image forming control portion 15 of the image forming apparatus 2 does not determine that the item, "flattening" is selected on the manipulation screen of the manipulation and display portion 14 at the step S110. As shown in FIG. 11, at a step S510, the image forming control portion 15 of the image forming apparatus 2 determines if the user selects an item, "cut-off processing" on a manipulation screen of the manipulation and display portion 14. If the image forming control portion 15 of the image forming apparatus 2 determines that the item, "cut-off processing" is selected on the manipulation screen of the manipulation and display portion 14, it goes to a step S520. If the image forming control portion 15 of the image forming apparatus 2 does not determine that the item, "cut-off processing" is selected on the manipulation screen of the manipulation and display portion 14, it goes to a step S600.

At the step S520, the image forming control portion 15 of the image forming apparatus 2 selects a current value of the driving motor 482 for elevation to be 3.0 A. Selecting the set current value to be 3.0 A is because the booklet-holding mechanism 51 is required to move to the cut-off processing portion 38 when selecting the cut-off processing so that a moving distance of the booklet-holding mechanism 51 becomes longer.

At a step S530, the image forming control portion 15 of the image forming apparatus 2 controls the booklet-holding mechanism. 51 holding the booklet S2 to move to the cut-off processing portion 38 at a movement speed of 400 mm/s by supplying the set current value of 3.0A to the driving motor 482 for elevation. The flattening unit 55 also moves to the cut-off processing portion 38 at a movement speed of 400 mm/s together with the movement of the booklet-holding mechanism 51.

At a step S540, the booklet-holding mechanism 51 including the flattening unit 55 reaches the cut-off processing portion 38. At a step S550, the image forming control portion 15 of the image forming apparatus 2 controls the cut-off processing portion 38 to perform the cut-off processing when the booklet-holding mechanism 51 including the flattening unit 55 reaches the cut-off processing portion 38.

At a step S560, the image forming control portion 15 of the image forming apparatus 2 controls the booklet-holding mechanism. 51 to move from the cut-off processing portion 38 to the discharging portion 39 at a movement speed of, for example, 400 mm/s by supplying the set current value of 3.0 A to the driving motor 482 for elevation when the cut-off processing portion 38 finishes the cut-off processing.

At a step S570, the booklet-holding mechanism 51 reaches the discharging portion 39. At a step S580, the image forming control portion 15 of the image forming apparatus 2 controls the booklet-holding mechanism 51 holding the booklet S2 to discharge the booklet S2 from the discharging portion 39 to a discharging tray, not shown.

At a step S590, the image forming control portion 15 of the image forming apparatus 2 controls the booklet-holding mechanism. 51 to move to the booklet receiving position P at a movement speed of, for example, 400 mm/s by supplying the set current value of 3.0 A to the driving motor 482 for elevation. This allows the booklet-holding mechanism 51 to return to the booklet receiving position P before the next booklet S2 reaches the booklet receiving position P.

On the other hand, if the image forming control portion 15 of the image forming apparatus 2 does not determine that the item, "cut-off processing" is selected on the manipulation screen of the manipulation and display portion 14 at the step S510, the image forming control portion 15 of the image forming apparatus 2 selects a current value of the driving motor 482 for elevation to be 2.0 A as a set current value at the step S600. It is because no cut-off processing is performed and the booklet-holding mechanism 51 is able to directly move to the discharging portion 39 not through the cut-off processing portion 38 so that a moving distance of the booklet-holding mechanism 51 becomes shorter to select the current value of the driving motor 482 for elevation to be 2.0 A.

At a step S610, the image forming control portion 15 of the image forming apparatus 2 controls the booklet-holding mechanism. 51 to move to the discharging portion 39 at a movement speed of, for example, 300 mm/s by supplying the set current value of 2.0 A to the driving motor 482 for elevation.

At a step S620, the booklet-holding mechanism 51 reaches the discharging portion 39. At a step S630, the image forming control portion 15 of the image forming apparatus 2 controls the booklet-holding mechanism 51 holding the booklet S2 to discharge the booklet S2 from the discharging portion 39 to a discharging tray, not shown, when the booklet-holding mechanism 51 reaches the discharging portion 39.

At a step S640, the image forming control portion 15 of the image forming apparatus 2 controls the booklet-holding mechanism. 51 to move to the booklet receiving position P at a movement speed of, for example, 300 mm/s by supplying the set current value of 2.0 A to the driving motor 482 for elevation. This allows the booklet-holding mechanism 51 to return to the booklet receiving position P before the next booklet S2 reaches the booklet receiving position P.

(Another Configuration Example of Second Holding Unit)

Figure 14A:
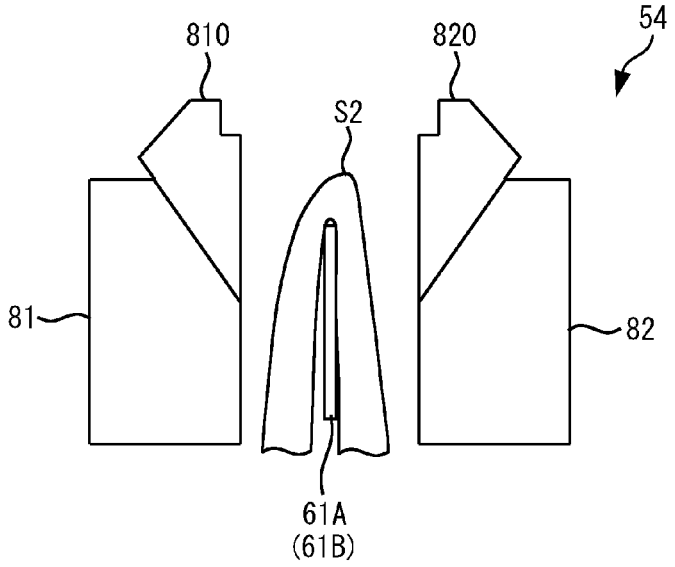
FIG. 14A is a diagram showing a configuration example of a second holding unit according to another embodiment of this invention.
Figure 14B:
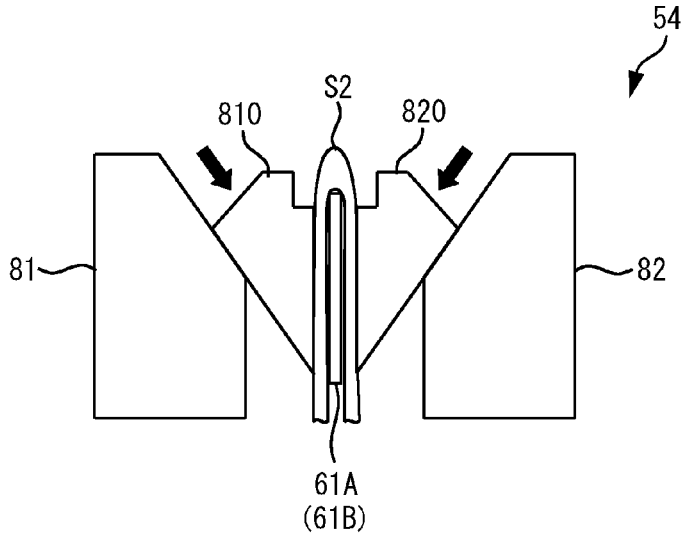
FIG. 14B is a diagram showing the configuration example of the second holding unit according to such another embodiment of this invention.

The following will describe a configuration example of the second holding unit 54 according to another embodiment of this invention. FIGS. 14A and 14B show such a configuration example of the second holding unit 54.

The pushing member 81 constituting the second holding unit 54 contains a booklet-fixing plate 810 for fixing a position of the booklet S2 and holding the booklet S2 at its end portion opposed to the receiving member 82. The booklet-fixing plate 810 has a flat surface on the side thereof opposed to the receiving member 82. The booklet-fixing plate 810 is diagonally slidable downward toward a side of the booklet S2 on the supporting plates 61A, 61B (see FIG. 14A). A sliding mechanism, not shown, including a motor for sliding the booklet-fixing plate 810 is connected to the booklet-fixing plate 810.

Similarly, the receiving member 82 constituting the second holding unit 54 contains a booklet-fixing plate 820 for fixing the position of the booklet S2 and holding the booklet S2 at its end portion opposed to the pushing member 81. The booklet-fixing plate 820 has a flat surface on the side thereof opposed to the pushing member 81. The booklet-fixing plate 820 is diagonally slidable downward toward a side of the booklet S2 on the supporting plates 61A, 61B (see FIG. 14A). A sliding mechanism, not shown, including a motor for sliding the booklet-fixing plate 820 is connected to the booklet-fixing plate 820.

When performing the flattening processing, these sliding mechanisms drive the booklet-fixing plates 810 and 820, respectively, to slide toward the side of the booklet S2 so that the booklet-fixing plates 810 and 820 press the booklet S2 from both sides. The booklet-fixing plates 810 and 820 fix the booklet S2 at a predetermined position and hold it (see FIG.

14B). The holding force by the booklet-fixing plates 810 and 820 may be set so that the position of the booklet S2 can be fixed without shifting it when performing the flattening processing and the cut-off processing. This allows the flattening processing and the cut-off processing to be performed under a stable condition.

As described above, according to the embodiments of this invention, the flattening processing is performed during the movement of the booklet S2 to the cut-off processing portion 38 and the discharging portion 39 and/or the cut-off processing of the booklet S2. This allows the productivity of the image forming system when performing the flattening processing to be improved as compared by a case when performing the flattening processing under a condition such that each of the conveying booklets stops temporarily.

According to the embodiments of this invention, the flattening unit 55 is configured to be movable between the cut-off processing portion 38 and the discharging portion 39 operating together with the movement of the booklet S2 so that the cut-off processing is performed on the booklet S2 while the flattening processing is performed on the booklet S2. This allows the flattening processing and the cut-off processing to be performed at the same time, which enables both of the flattening processing and the cut-off processing to be performed in a short time.

According to the embodiments of this invention, when performing the flattening processing and the cut-off processing at the same time, it may be controlled so that the start timing of the driving motor 555 for square-back-roller shifts the start timing of the driving motor 380 for cutting-off processing. This can prevent the start current value of their motors from exceeding the rated current value of the power source thereof, which allows the current consumption to be controlled in the driving motor 555 for square-back-roller and the driving motor 380 for cutting-off processing.

According to the embodiments of this invention, the current value of the driving motor 482 for elevation, which drives the elevating mechanism 48, or the like is configured to be changed based on whether or not the flattening processing is performed, and a period of flattening time. A moving speed of the booklet-holding mechanism 51 (the flattening unit 55) is configured to be changed. Further, the current value of the driving motor 482 for elevation or the like is configured to be changed based on whether or not the cut-off processing is performed, and a moving speed of the booklet-holding mechanism 51 is configured to be changed. This enables any optimal current to be supplied to the driving power source to control the current consumption.

It should be understood by those skilled in the art that various modifications, combinations, sub-combinations and alterations may occur depending on design requirements and other factors insofar as they are within the scope of the appended claims or the equivalents thereof. Although the flattening processing has been performed while the booklet S2 is moved to the cut-off processing portion 38, when cutting off the edge of the booklet S2 and while the booklet S2 is moved from the cut-off processing portion 38 to the discharging portion 39 in the above embodiments, the invention is not limited thereto. For example, the flattening processing can be performed at any timing when the booklet S2 is moved.

Although the monochrome image forming apparatus 2 has been described in the above embodiments, the invention is not limited thereto. The invention may be applied to an image forming apparatus that can form a color image on the sheet of paper.

What is claimed is:

1. A post-processing apparatus comprising:

a booklet-forming portion that performs saddle stitching processing on a sheet of paper to form a booklet;

a flattening portion that flattens a back portion of the booklet formed by the booklet-forming portion to form a squared back portion of the booklet;

a moving portion that moves the flattening portion operating together with a conveyance of the booklet;

a control device that is configured to control the flattening portion to perform flattening processing which flattens the back portion of the booklet to form the squared back portion of the booklet during the conveyance of the booklet by the moving portion; and a cut-off processing portion that cuts off an edge of the booklet, wherein the control device is configured to control the cut-off processing portion to cut off the edge of the booklet during the flattening processing by the flattening portion.

2. The post-processing apparatus according to claim 1, further comprising:

a first driving portion that drives the flattening portion; and a second driving portion that drives the cut-off processing portion, wherein the control device is configured to control the first driving portion and the second driving portion, respectively, to allow a start timing of the first driving portion to be different from a start timing of the second driving portion.

3. The post-processing apparatus according to claim 1, wherein the control device is configured to change a moving speed of the moving portion based on whether or not the flattening portion flattens the back portion of the booklet.

4. The post-processing apparatus according to claim 1, further comprising a driving portion that drives the moving portion, wherein the control device is configured to change a current value of the driving portion based on whether or not the flattening portion flattens the back portion of the booklet.

5. The post-processing apparatus according to claim 1, wherein the control device is configured to change a moving speed of the moving portion based on a period of time when the flattening portion flattens the back portion of the booklet.

6. The post-processing apparatus according to claim 1, further comprising a driving portion that drives the moving portion, wherein the control device is configured to change a current value of the driving portion based on a period of time when the flattening portion flattens the back portion of the booklet.

7. The post-processing apparatus according to claim 1, wherein the control device is configured to change a moving speed of the moving portion based on whether or not the cut-off processing portion cuts off the edge of the booklet.

8. The post-processing apparatus according to claim 1, further comprising a driving portion that drives the cut-off processing portion, wherein the control device is configured to change a current value of the driving portion based on whether or not the cut-off processing portion cuts off the edge of the booklet.

9. The post-processing apparatus according to claim 1, wherein the flattening portion flattens the back portion of the booklet to form the squared back portion of the booklet by moving a square back roller along the back portion of the booklet.

10. The post-processing apparatus according to claim 9, wherein the flattening portion flattens the back portion of the booklet to form the squared back portion of the booklet by reciprocatively moving the square back roller along the back portion of the booklet.

11. An image forming system comprising:

an image forming apparatus that forms an image on a sheet of paper; and a post-processing apparatus that performs a post-processing on the sheet of paper supplied from the mage forming apparatus, wherein the post-processing apparatus contains:

a booklet-forming portion that performs saddle stitching processing on a sheet of paper to form a booklet;

a flattening portion that flattens a back portion of the booklet formed by the booklet-forming portion to form a squared back portion of the booklet;

a moving portion that moves the flattening portion operating together with a conveyance of the booklet;

a control device that is configured to control the flattening portion to perform flattening processing which flattens the back portion of the booklet to form the squared back portion of the booklet during the conveyance of the booklet by the moving portion; and a cut-off processing portion that cuts off an edge of the booklet, wherein the control device is configured to control the cut-off processing portion to cut off the edge of the booklet during the flattening processing by the flattening portion.

12. The image forming system according to claim 11, wherein the flattening portion flattens the back portion of the booklet to form a squared back portion of the booklet by moving a square back roller along the back portion of the booklet.

13. The image forming system according to claim 12, wherein the flattening portion flattens the back portion of the booklet to form the squared back portion of the booklet by reciprocatively moving the square back roller along the back portion of the booklet.

* * * * *